US006137509A

United States Patent [19]

Hayasaki

[11] Patent Number: 6,137,509

[45] **Date of Patent: *Oct. 24, 2000**

[54] RECORDING APPARATUS HAVING A SUBSTRATE FOR A RECORDING HEAD AND METHOD OF PRODUCING THE SAME

[75] Inventor: Kimiyuki Hayasaki, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/302,416

[22] Filed: Sep. 8, 1994

[30] Foreign Application Priority Data

Sep. 8, 1993 [JP] Japan ..... 5-223593

[51] Int. Cl.[7] ..... B41J 2/05; B41J 2/14; B41J 2/16; B41J 2/355

[52] U.S. Cl. ..... 347/59; 347/49; 347/50; 347/180

[58] Field of Search ..... 347/43, 50, 59, 347/49, 180

[56] References Cited

U.S. PATENT DOCUMENTS

| | | | |
|---|---|---|---|
| 4,091,391 | 5/1978 | Kozima et al. | 347/180 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,719,477 | 1/1988 | Hess | 346/140 R |
| 4,723,129 | 2/1988 | Endo et al. | 346/1.1 |
| 4,740,796 | 4/1988 | Endo et al. | 346/1.1 |
| 5,212,503 | 5/1993 | Saito et al. | 346/140 R |
| 5,359,357 | 10/1994 | Takagi et al. | 347/49 |

FOREIGN PATENT DOCUMENTS

| | | |
|---|---|---|
| 0532877 | 3/1993 | European Pat. Off. . |
| 0534495 | 3/1993 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

A substrate for a recording head has a plurality of recording elements, a plurality of functional elements electrically connected to the recording elements, and a common electrode electrically connected to the recording elements and selectively feeding a driving signal to the recording elements on a base boad. Also, the common electrode is prepared as a layer by the same step as that of forming a conductor electrode layer to be electrically connected to a semiconductor layer constituting the functional elements arranged in the substrate. Therefore, the recording apparatus, can be prepared by the process including the step of forming the recording elements and simultaneously connecting these elements to reduce the number of film forming operations.

22 Claims, 16 Drawing Sheets

RECORDING APPARATUS HAVING A SUBSTRATE FOR A RECORDING HEAD AND METHOD OF PRODUCING THE SAME

BACKGROUND OF THE INVENTION

1. Field of the Invention

The present invention relates generally to a substrate of a recording head for recording inputted information such as characters, figures or the like, a recording head, a recording head cartridge, and a method of producing a substrate for a recording head. More particularly, the present invention relates to a substrate used for an ink-jet recording head that includes an electrical circuit for selectively feeding a driving signal to a plurality of recording elements arranged in a same base board.

2. Description of the Related Art

Various kinds of recording apparatuses each having a plurality of recording elements arranged in a row for recording characters, figures or the like on a recording medium have been hitherto known. In general, a recording apparatus of the foregoing type includes recording means having a plurality of recording elements and a driving integrated circuit capable of simultaneously driving a predetermined number of recording elements as a single block mounted on a same base board. With such construction, it is possible to execute arbitrary recording on a recording medium (sheet of recording paper, cloth, sheet of plastic material or the like) by arranging image data corresponding to the respective recording elements. Among conventional recording apparatuses as mentioned above, an ink jet type recording apparatus adapted to execute recording on a recording medium by ejecting ink from a plurality of ejecting ports disposed on the recording elements while generating few noisy sound without any impact induced by each recording operation makes it possible to perform each recording operation not only at a high density but also at a high speed. For this reason, a number of ink jet type recording apparatuses are utilized for an information processing system on the commercial basis. In practice, the ink jet recording apparatus is used as a printer located at an output terminal of, e.g., a copying machine, a facsimile, a computer, a word processor, a work station or the like or as a handy or portable printer to be equipped in operative association with a personal computer, a host computer, an optical disc unit, a video unit or the like. A conventional recording apparatus as mentioned above includes recording means (recording head), conveying means for conveying a recording medium, driving means for reciprocally displacing a recording head in the direction at a right angle relative to the direction of conveyance of a recording medium, and controlling means for controlling the ejection of ink from the recording head, the conveyance of a recording medium and the reciprocal displacement of the recording head with the aid of driving means. The recording head adapted to eject ink droplets from a plurality of ejection ports thereof is serially scanned in the direction at a right angle relative to the direction of conveyance of the recording medium. (i.e., in the main scanning direction) and subsequently, the recording medium is intermittently conveyed at a quantity of displacement thereof equal to the recorded width of the recording medium while no recording operation is performed. With this recording method, recording is executed in response to a recording signal by ejecting ink onto the recording medium. For this reason, the foregoing recording method is widely used as a quiet recording system capable of being practiced-at an inexpensive running cost. When a number of nozzles each adapted to eject ink therefrom are formed on the recording head along a straight line extending at a right angle relative to the direction of displacement of the recording head relative to the recording medium, recording can be executed by a quantity of width corresponding to the number of nozzles by simultaneously scanning the recording head and the recording medium. This makes it possible to perform a printing operation at a higher speed.

It should be added that a recording apparatus capable of forming a full color image with a recording head adapted to eject three or four kinds of inks mounted thereon has been put in practical use. A primary color mixing method is utilized for a color image forming apparatus of the foregoing type. Namely, each of all colors is obtainable by mixing three kinds of primary colors at a predetermined mixing rate. For example, in the case that yellow and red are mixed with each other, the resultant color is red. In addition, in the case that magenta and cyan are mixed with each other, the resultant color is blue. Thus, a various kind of color can be obtained based on the three primary colors as mentioned above. Usually, three kinds of recording heads, i.e., a yellow color recording head, a magenta color recording head and a cyan color recording head (of which mounting order is not definitely determined) are mounted on an ink jet recording apparatus adapted to form a multi-color image in accordance with a serial scanning system in the direction of displacement of the recording heads (i.e., in the main scanning direction). To improve the visual tone of a recorded multi-color image, it is desirable that a black color recording head is additionally mounted on the ink jet recording apparatus.

Each of the recording heads includes means for generating energy required for ejecting ink therefrom (hereinafter referred to as "recording element"), and moreover, requires a common electrode for distributively feeding a recording electric current to a plurality of recording elements. With this construction, it is necessary that the common electrode is disposed on a same base board adjacent to a group of recording elements having a plurality of recording elements arranged in parallel with each other. To this end, the common electrode is formed for a conventional ink jet recording apparatus in the following manner. For example, as disclosed in U.S. Pat. No. 5,212,503, a method which is practiced in such a manner that because of a necessity for disposing plural groups of recording elements in the vicinity of the edge portion of the base board, each conductor for electrically connecting each of the recording elements and the common electrode to each other is folded back at the position in the vicinity of the base board, the common electrode for feeding a recording electrical current to the recording elements is disposed at the position located inward of the base board away from plural groups of recording elements placed on the base board while extending in parallel with the end part of the group of recording elements, and the common electrode is electrically connected to a metallic film (second conductor portion) formed on the base board via through holes as well as a method which is practiced such that a plurality of recording elements, a group of functional elements for individually driving the recording elements (e.g., transistor array), and a driving integrated circuit for arranging image data corresponding to the recording elements are structurally disposed in the interior of a same base board can be noted as typical methods employable for forming the common electrode.

FIG. 1 shows one of the example of the ink-jet recording head using the same base board described above. Reference numeral 901 denotes a semiconductor substrate plate formed by a single crystal silicon. Reference numeral 902 denotes an N type semiconductor collector region. Reference numeral 903 denotes an ohmic contact region of N type semiconductor containing a high impurity concentration. Reference numeral 904 denotes a base region of P type semiconductor. Reference numeral 905 denotes a high impurity concentration, the regions 901 to 905 define a bipolar transistor 920. Reference numeral 907 denotes a boron hafnium layer as a heating resistance layer. Reference numeral 908 denotes an aluminum electrode. Reference numeral 909 denotes a silicon oxide layer as a protective layer. The regions 901 to 909 form a substrate 930 for recording head. In the layer configuration shown in FIG. 1, reference numeral 940 denotes a heating portion. A top plate 910 defines a liquid passage (ink passage) 950 in cooperation with the substrate 930.

A lot of improvements and proposals have been made with respect to the recording head having structures mentioned above. Recently, specific performance improvements have been further required in the recording head, such as attaining higher speed derivability, saving energy consumption, higher integration density, lower cost, higher reliability and high level functionality.

Accordingly, in order to provide a recording head with a reduced chip size, higher density integration of functional devices for driving electrothermal transducers, higher performances, higher recording ability and a lower cost of the structure of the recording head can be formed in the form of an MOS transistor array, as shown in FIG. 2A and FIG. 2B, for instance.

That is, the MOS transistor array comprises a P type silicon substrate, an oxide film 2, a guard ring 3, n+ drain region 4, an n+ source region 5. P type channel region 19, a source electrode 6, a drain electrode 7, and a gate electrode 8.

However, since the conventional recording head is constructed in the above-described manner, it is necessary that a functional element including a driving element array and a driving integrated circuit, a plurality of recording elements, and a second conductor portion for connecting the recording elements to each other are prepared by way of different steps. In the case that a common electrode for feeding electricity to the respective recording elements is disposed in accordance with a production process including the foregoing different steps, there arises a necessity for forming a plurality of metallic films to assume a multi-layered structure when a plurality of recording elements and various kinds of conductor portions are prepared in the form of films. In this case, an additional step of preparing the metallic films having a multi-layered structure is required, and moreover, there sometimes arises an occasion that a trouble such as short-circuit between metallic layers or the like occurs. In addition, in the case that a bias spattering process is practiced with the recording apparatus having different process conditions via a step of forming a driving integrated circuit, there sometimes arises an occasion that semiconductor properties ot the driving integrated circuit in the substrate are deteriorated. To cope with the foregoing problem, a proposal has been made with respect to a method which is practiced such that an electrical conductive layer having a comparatively small width of conductor is formed along the edge portion on the end part side of a substrate away from. a row of recording elements without any formation of metallic films having a multi-layered structure. However, this proposed method is not a desirable method because when an intensity of recording electric current is increased, there appears a problem that a magnitude of conductor resistance is undesirably increased due to a small width of conductor. Additionally, another proposal has been made with respect to a method which is intended to alleviate the foregoing problem. However, this method has a problem associated with a process including a step of patterning or the like. At any rate, any one of the aforementioned proposed methods has a factor of reducing a yielding rate of producing a recording apparatus.

SUMMARY OF THE INVENTION

It is an object of the present invention to provide a recording apparatus including, a plurality of recording elements and a common electrode wherein the recording apparatus is constructed such that the recording elements and conductor portions for the recording elements can simultaneously be formed during a step of forming a metallic film for the conductor portions in accordance with a film forming process of forming a plurality of recording elements and their conductor portions, a driving integrated circuit including a plurality of functional elements in a substrate can hardly be affected due to a difference in process, and a yielding rate of producing a recording apparatus can be improved.

According to a first aspect of the present invention, there is provided a recording apparatus comprising:

a recording head used for recording inputted information on a recording medium by ejecting a recording liquid from a plurality of orifices formed thereon;

means for supplying a driving signal for driving the recording head; and means for transferring the recording medium, wherein the recording head includes:

a substrate in which a plurality of recording elements selectively driven for heating the recording liquid;

a plurality of functional elements electrically connected to the recording elements;

a functional element for selectively feeding a driving signal to the recording elements so as to eject ink from a plurality of ejection ports formed on the recording head; and a common electrode for feeding the driving signal to the recording elements are arranged, which is prepared in the form of a layer that is formed during the same step as that of forming a conductor electrode layer to be electrically connected to a semiconductor layer constituting the functional elements arranged in the substrate.

Here, the common electrode may be electrically connected to a metallic film formed above the common electrode via an electrical insulative layer and through holes.

The recording elements may be prepared in the form of a film under the conditions different from those employable for a step of involving the common electrode, the functional elements and a driving integrated circuit in the substrate.

The recording head may be in the type of an ink-jet recording head and the recording element may be a thermal transducer for generating thermal energies in correspondence with the driving signal to cause film boiling in the recording liquid and thereby eject the recording liquid from the orifices.

The recording head detachably may connect with an ink tank to form a recording cartridge and may receive the recording liquid from the ink tank.

The recording medium may be selected from paper, cloth, and plastic sheet.

The recording liquid may be ink.

According to a second aspect of the present invention, there is provided a color recording apparatus comprising:

a recording head used for recording inputted color information on a recording medium by ejecting a recording liquid from a plurality of orifices formed thereon;

means for supplying a driving signal for driving the recording head; and means for transferring the recording medium, wherein the recording head includes:

a substrate in which a plurality of recording elements selectively driven for heating the recording liquid;

a plurality of functional elements electrically connected to the recording elements;

a functional element for selectively feeding a driving signal to the recording elements so as to eject ink from a plurality of ejection ports formed on the recording head; and a common electrode for feeding the driving signal to the recording elements are arranged, which is prepared in the form of a layer that is formed during the same step as that of forming a conductor electrode layer to be electrically connected to a semiconductor layer constituting the functional elements arranged in the substrate.

Here, the common electrode may be electrically connected to a metallic film formed above the common electrode via an electrical insulative layer and through holes.

The recording elements may be prepared in the form of a film under the conditions different from those employable for a step of involving the common electrode, the functional elements and a driving integrated circuit in the substrate.

The recording head may be in the type of an inkjet recording head and the recording element may be a thermal transducer for generating thermal energies in correspondence with the driving signal to cause film boiling in the recording liquid and thereby eject the recording liquid from the orifices.

The recording head detachably may connect with an ink tank to form a recording cartridge and may receive the recording liquid from the ink tank.

The recording medium may be selected from paper, cloth, and plastic sheet.

The recording liquid may be ink.

The recording head may serve as multi-color recording means having groups of a plurality of recording element assembled with each other corresponding to plural kinds of colors to be used, and that a plurality of common electrodes are dividedly arranged corresponding to the plural kinds of colors on the block unit basis.

The groups of a plurality of recording elements may be cascade-connected to each other.

According to a third aspect of the present intention, there is provided a substrate for a recording head used for recording inputted information on a recording medium, comprising:

a plurality of recording elements;

a plurality of functional elements electrically connected to the recording elements;

a functional element for selectively feeding a driving signal to the recording elements; and a common electrode electrically connected to the recording elements on the common basis, wherein the common electrode is prepared in the form of a layer which is formed during the same step as that of forming a conductor electrode layer to be electrically connected to a semiconductor layer constituting the functional elements.

Here, the common electrode may be electrically connected to a metallic film formed above the common electrode via an electrical insulative layer and through holes.

The recording elements may be prepared in the form of a film under the conditions different from those employable for a step of involving the common electrode, the functional elements and a driving integrated circuit in the substrate.

The recording head may serve as multi-color recording means having groups of a plurality of recording elements assembled with each other corresponding to plural kinds of colors to be used, and that a plurality of common electrodes are dividedly arranged corresponding to the plural kinds of colors on the block unit basis.

The groups of a plurality of recording elements may be cascade-connected to each other.

The recording head may be in the type of an ink-jet recording head and the recording element may be a thermal transducer for generating thermal energies in correspondence with the driving signal to cause film boiling in the recording liquid and thereby eject the recording liquid from the orifices.

According to a third aspect of the present invention, there is provided a method of producing a recording apparatus using a recording head having a substrate including a plurality of recording elements, a plurality of functional elements electrically connected to the recording elements, a functional element for selectively feeding a driving signal to the recording elements, and a common electrode electrically connected to the recording elements on the common basis, comprising:

a step of involving a plurality of functional elements in a semiconductor base board;

a step of forming a conductor electrode layer to be electrically connected to a semiconductor layer constituting the functional elements and a common conductor electrode layer to be electrically connected to a plurality of recording elements on the common basis;

a step of forming an electrical insulative layer above each of the conductor electrode layers;

a step of forming a resistor layer above at least a part of the electrical insulative layer so as to generate heat with the resistor layer; and a step of forming a conductor electrode layer to be electrically connected to the heat generating resistor layer, and moreover, electrically connected to the common conductor electrode layer via contact holes formed through the electrically insulative layer.

Here, the plurality of common electrodes may be dividedly arranged into a plural groups that receive different voltages.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the present invention will now be described, by way of example, and with reference to the accompanying drawings in which.

DETAILED DESCRIPTION OF PREFERRED EMBODIMENTS

Figure 1:
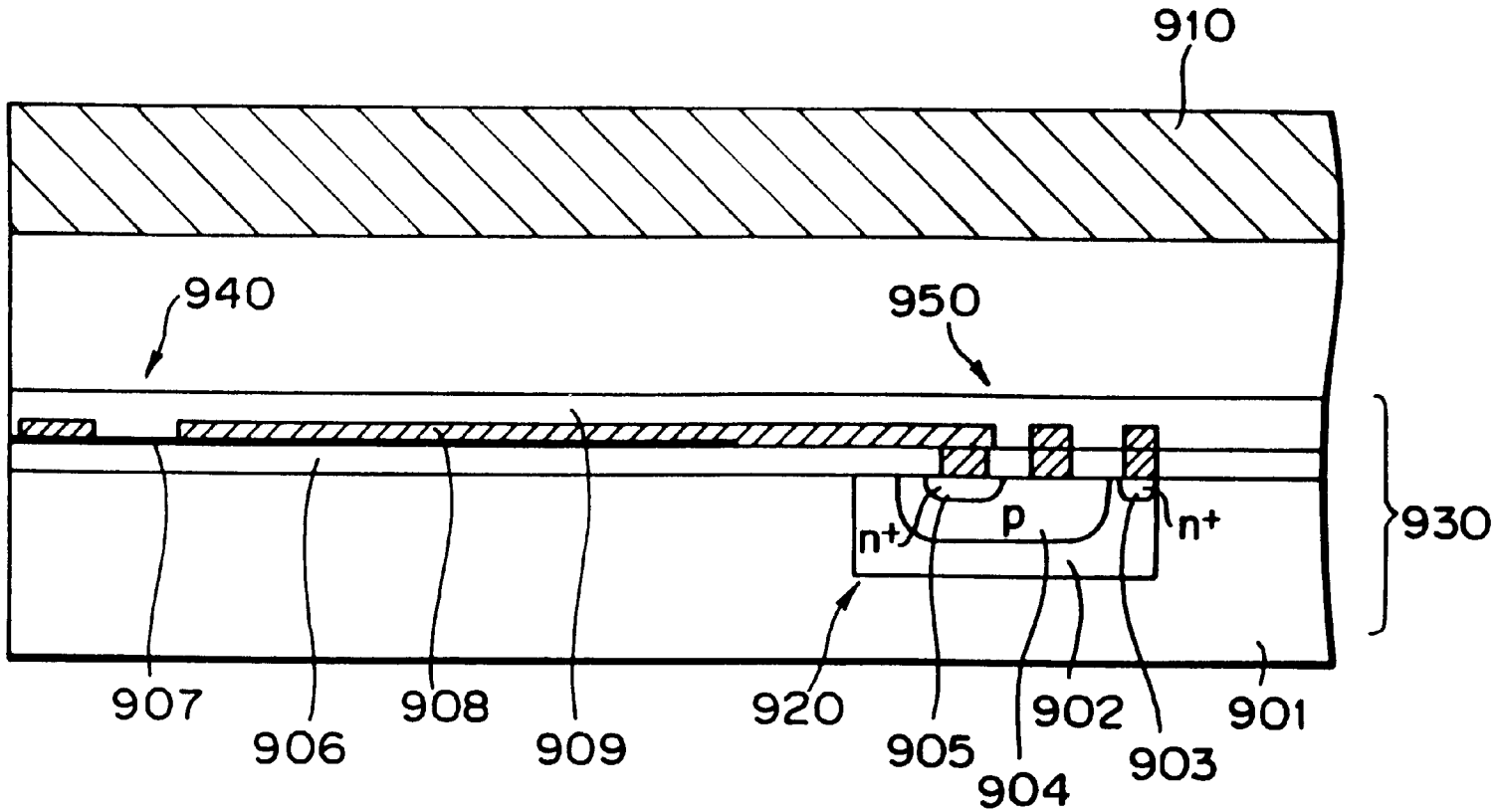
FIG. 1 PRIOR ART
FIG. 1 is a schematic sectional view showing a recording head showing a technology related to the present invention and illustrating the comparison with a recording head of the present invention.
Figure 2A:
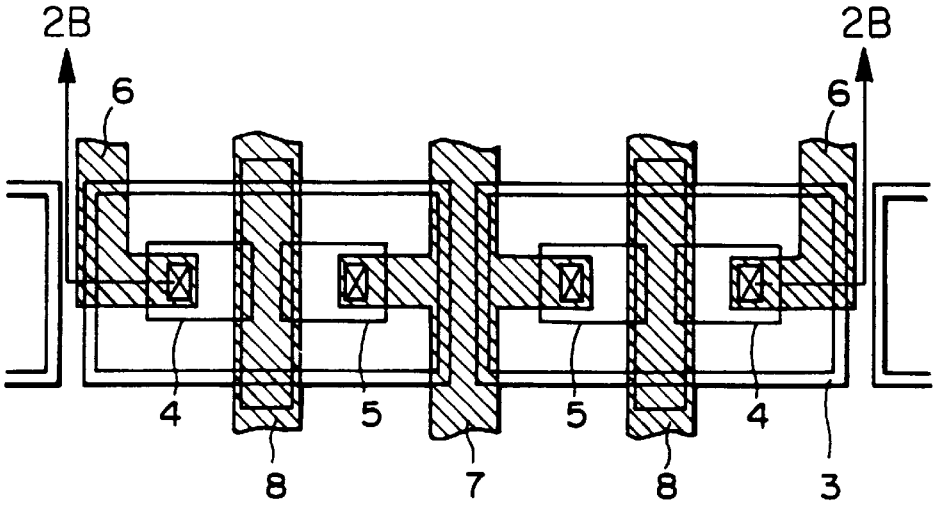
FIG.2A PRIOR ART
FIG. 2A and FIG. 2B are, respectively, a plan view (FIG. 2A) and a sectional view (FIG. 2B), taken along line 2B—2B in FIG. 2A showing an MOS transistor array showing a technology related to the present invention and illustrating the comparison with an MOS transistor array of the present invention.
Figure 2B:
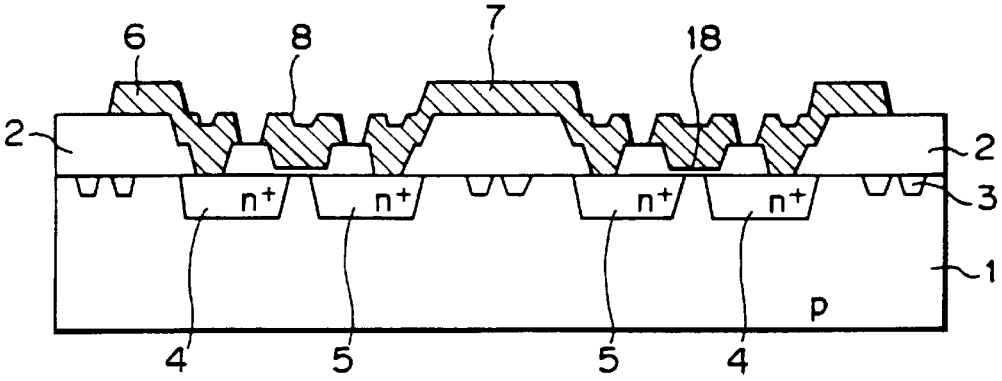
FIG.2B PRIOR ART

Throughout the following detailed description, similar reference numerals refer to similar elements in all figures of the drawings.

The present invention is not to be interpreted in a limiting sense, and may be adapted to various embodiments and modification satisfying the purpose of the invention.

Figure 3:
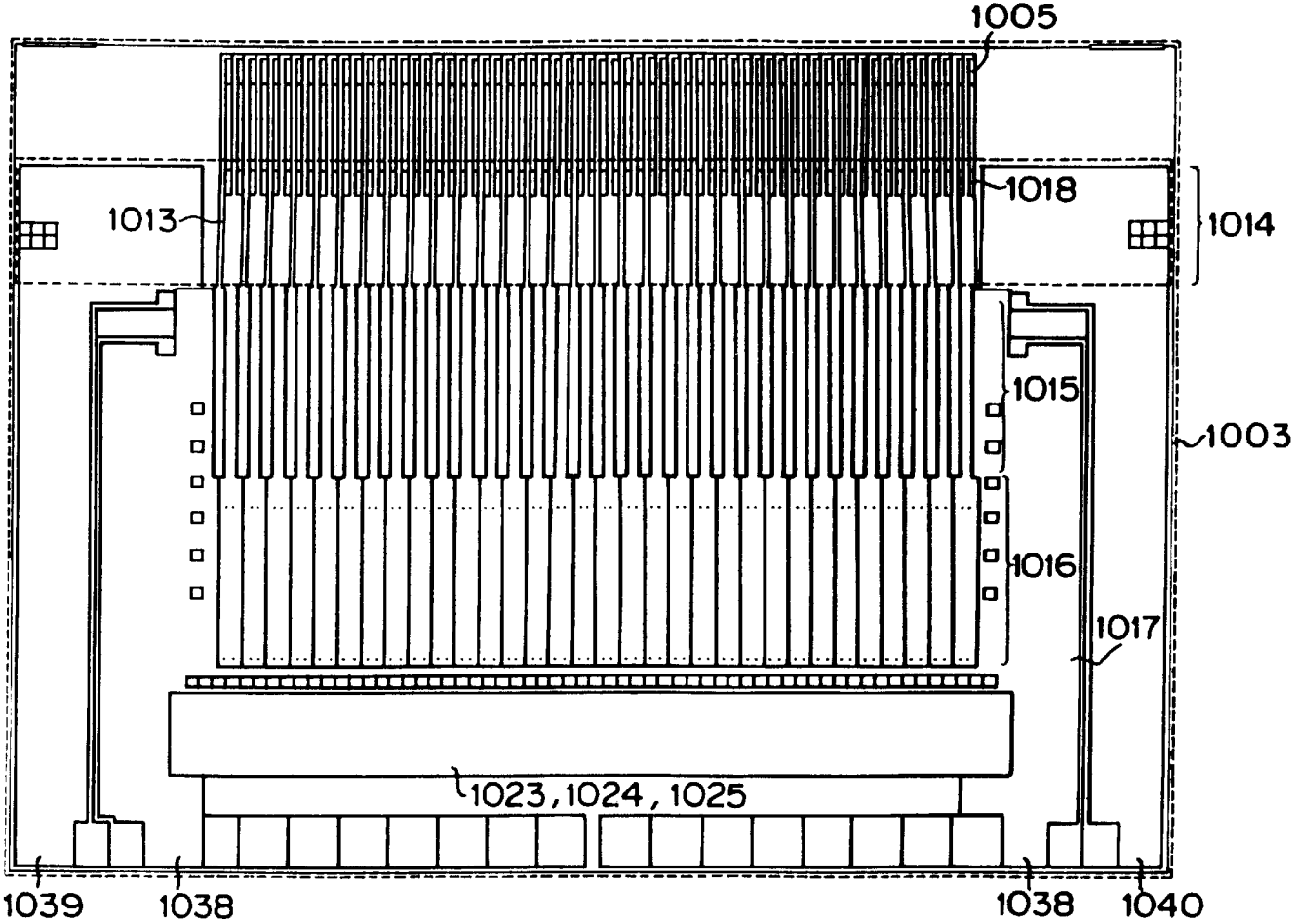
FIG. 3 is a schematic plan view which illustratively explains the structure of a base board for recording means to be equipped in a recording apparatus constructed in accordance with an embodiment of the present invention.

FIG. 3 is a schematic plan view which illustratively explains the structure of a base board to be used for recording means equipped for an ink jet recording apparatus constructed in accordance with an embodiment of the present invention. A plurality of recording elements 1005 are arranged in the side-by-side relationship as seen in the longitudinal direction of the base board 1003 while extending in parallel with each other, and each of the recording elements 1005 is electrically connected to a common electrode 1014 so as to allow electricity to be fed to each recording element 1005 from a power source via a through hole 1018. Here, each of the recording elements 1005 is exemplified by a recording element of the type having an electromechanical transducer such as a piezo element or the like used therefor, a recording element of the type adapted to eject a liquid droplet by the function of heat generated as an electromagnetic wave such as a laser light beam is irradiated thereto, and a recording element of the type adapted to heat liquid with the aid of an electrothermal converting element including a heat generating resistor for the purpose of ejecting liquid from a recording head of the recording apparatus.

Among various kinds of recording heads, a recording head of the type adapted to eject liquid therefrom by utilizing thermal energy makes it possible to perform a recording operation with a high degree of resolution because a plurality of liquid ejection ports can be arranged on the recording head at a high density. Especially, a recording head of the type having a plurality of electrothermal transducers used therefor as energy generating means is advantageously employable for a recording apparatus because the recording head can easily be constructed with small dimensions, advantages obtainable from an advanced technology in the latest semiconductor field, an integral circuit technology having remarkably improved reliability and a micro-machining technology likewise having remarkably improved reliability can sufficiently be utilized, a plurality of electrothermal transducers can easily be arranged on the recording head at a high density on the practical application basis, and moreover, they can be produced at an inexpensive cost.

In FIG. 3, reference numeral 1039 designates an electricity feeding pad for feeding electricity to each recording element 1005 from a power source (hereinafter referred to as VH), and reference numerals 1015 and 1016 designate a plurality of conductors each of which extends to a driving element array so as to allow the latter to serve for properly controlling the feeding of electricity to the recording elements 1005 from the power source in order to enable a printing operation to be achieved at a high density. However, description on the conductors 1115 and 1016 is herein eliminated for the purpose of simplification. Reference numeral 1017 designates a common recording electric current grounding electrode (hereinafter referred to as GND) which extends from the conductor 1015, and an area of the common recording electric current grounding electrode 1017 is determined depending on an intensity of electric current to be fed to each recording element 1005 (a part of the base board 1003 designated by reference numeral 1038 represents an grounding pad for the common recording electric current grounding electrode 1017). In this embodiment, in addition to the driving element array, a functional element, e.g., a driving integral circuit substantially composed of a Boolean gate logic portion 1023,.a latching circuit portion 1024 and a shift register 1026 is embedded below the surface of the base board 1003 (see FIG. 4).

Figure 4:
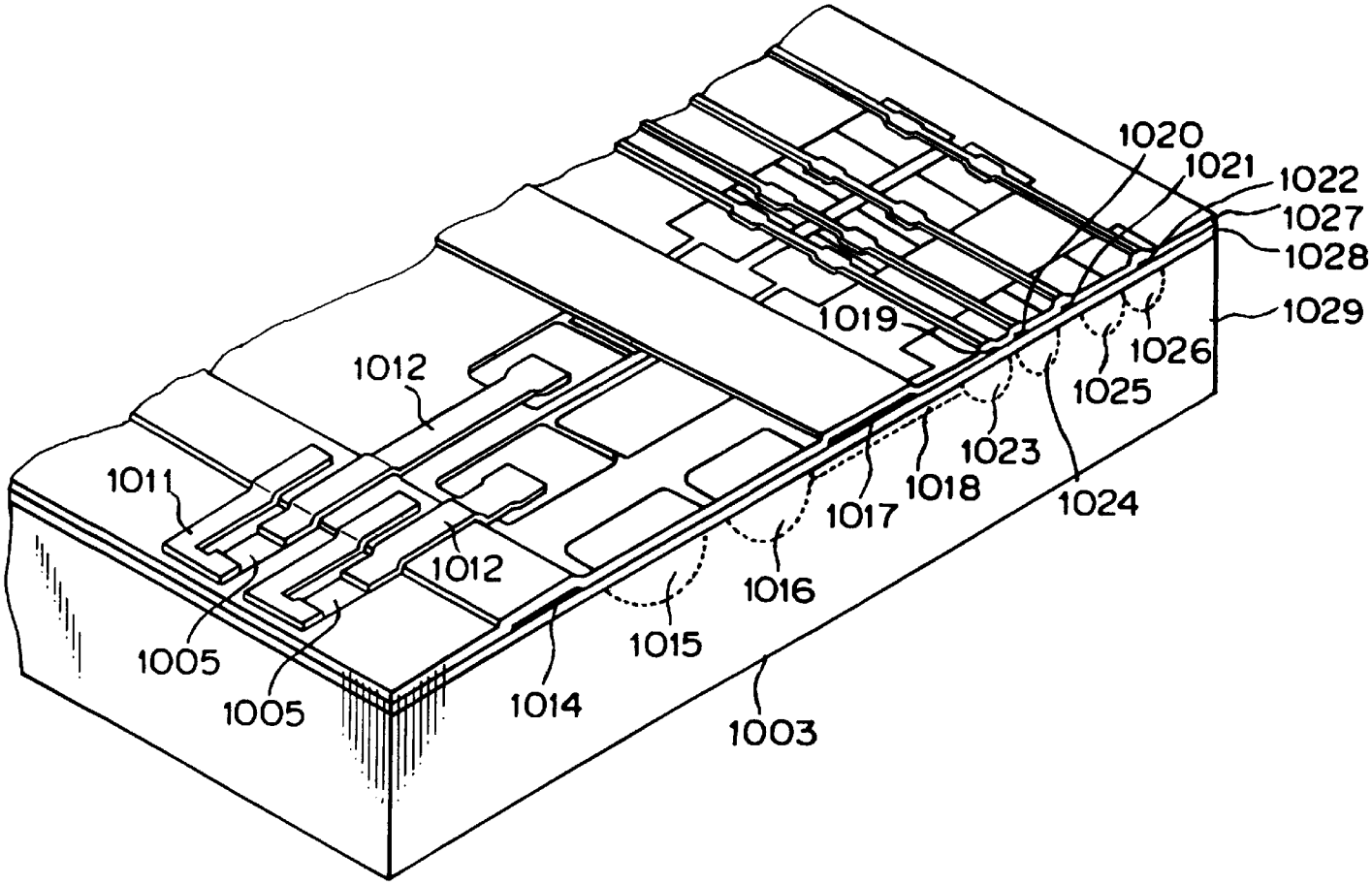
FIG. 4 is a schematic fragmentary enlarged perspective view which illustratively explains the inner structure of the base board for the recording means shown in FIG. 3.

FIG. 4 is a schematic fragmentary perspective view which illustratively explains the inner structure of the base board shown in FIG. 3 wherein the base board is disposed in recording means equipped in the ink jet recording apparatus constructed in accordance with the embodiment of the present invention. As is apparent from the drawing, the base board 1003 is constructed by forming a laminated structure on the surface of a silicon substrate. In FIG. 4, reference numeral 1005 designates a recording element, reference numeral 1011 designates a second layer conductor which extends from the recording element 1005 to VH, and reference numeral 1012 likewise designates a second layer conductor which extends between a recording element 1005 and an electrode specific to a functional element corresponding to the recording element 1005. Each of the second layer conductors 1011 and 1012 is made of an electrical conductive material such as aluminum or the like. In addition, reference numeral 1014 designates a VH conductor, reference numeral 1015 designates a first row of functional elements, and reference numeral 1016 designates a second row of functional elements. A plurality of the second layer conductors 1012 are electrically connected to the first row of functional elements 1015 and the second row of functional elements 1016 while exhibiting a zigzag pattern, whereby the recording elements 1005 can be arranged at a high density. Additionally, reference numeral 1017 designates a GND conductor, and reference numeral 1018 designates a base conductor or agate conductor for the functional elements which is moldably received in the interior of the base board 1003 using a synthetic resin such as polysilicon or the like. Reference numerals 1019, 1020, 1021 and 1022 designate conductors which are moldably received for a latch, serial data, a clock or the like in the first layer in the same manner as the GND conductor 1017 using the same synthetic resin as mentioned above, respectively. Each of the conductors 1019, 1020, 1021 and 1022 is made of the same electrical conductive material as that used for the second layer.

Reference numeral 1023 designates a Boolean gate logic, reference-numerals 1024 and 1025 designates a latch, and reference numeral 1026 designates a shift register circuit. In addition, reference numeral 1027 designates an electrical insulative film for electrically isolating the first layer from the second layer, reference numeral 1028 designates a heat accumulating layer, and reference numeral 1029 designates a silicon substrate. The recording elements 1005 and the associated conductors placed on the silicon substrate 1029 are produced by employing a process different from that employed for producing components received in the silicon substrate 1029.

Figure 5:
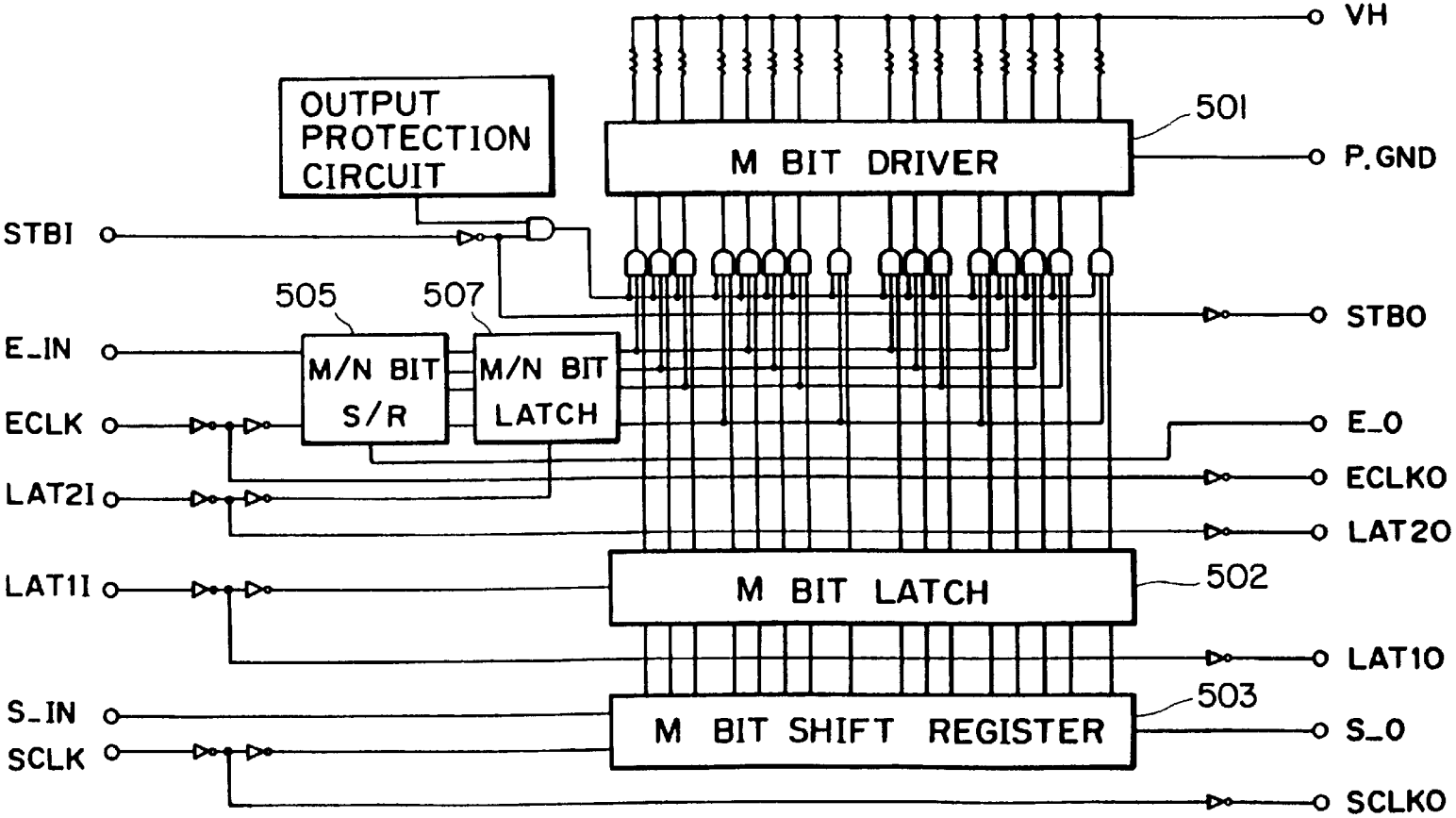
FIG. 5 is a block diagram which illustratively explains the circuit structure for the recording means constructed in accordance with the embodiment of the present invention.

FIG. 5 is a block diagram which schematically shows the circuit structure of recording means to which the present invention is applied. An M bit driver 501 serves as functional elements for controllably feeding electricity to the respective recording elements of which number is coincident with that of the functional elements. An M bit shift register 503 serves as a shift register circuit which causes image data to be arranged corresponding to the recording elements, and the shift register circuit is electrically connected directly to a latch circuit which is represented by an M bit latch 502 for holding data by a quantity corresponding to the recording elements. In addition, an M/N bit register 505 and an M/N bit latch 507 serve as means for separately driving the recording elements corresponding to the number N of recording elements to be simultaneously driven. Concretely, the M/N bit shift register 505 and the M/N bit latch 507 are constructed by a 16 bit shift register and a 16 bit latch circuit (in the shown case, M=64, N=8, N=2). When an output from means for separately driving the M/N bit shift register and the M/N bit latch on the decentralizing basis, an output from the latch circuit and an output-from a strobe terminal (STBI) for controlling a period of time when electricity is fed to the recording elements become active, the recording elements corresponding to the image data are driven via an AND circuit.

Figure 6:
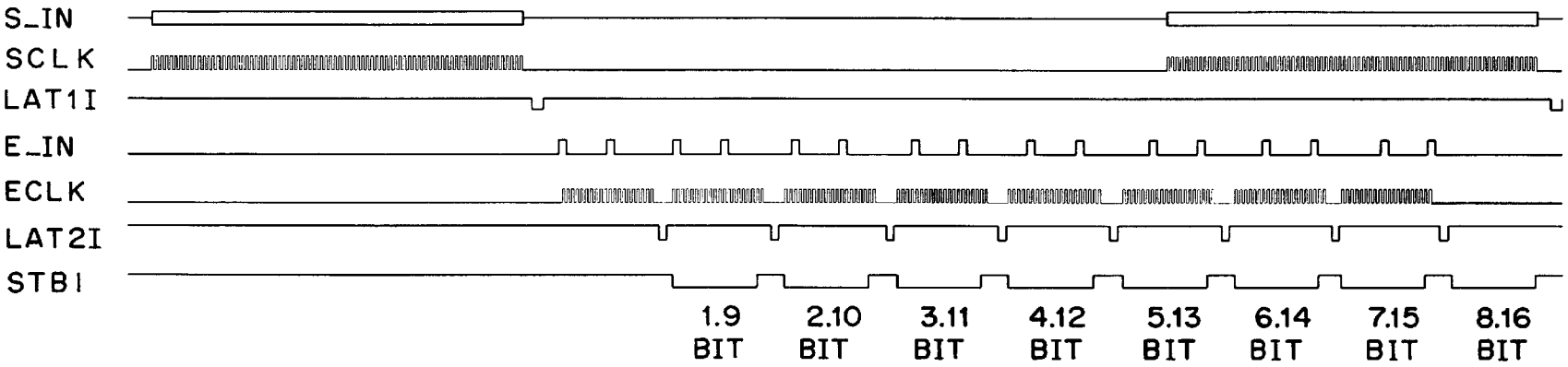
FIG. 6 is timing charts each representing the driving of the recording apparatus constructed in accordance with the embodiment of the present invention.

FIG. 6 shows a plurality of timing charts each representing the driving of a circuit in recording means to which the present invention is applied. When a series of image data signals (S_I) are inputted into a controlling unit (not shown) for the recording apparatus, they are sequentially transferred to the recording means while image data are arranged corresponding to the recording elements. This makes it possible to feed electricity to the respective recording elements based on the image data for a time corresponding to the period of a latch pulse signal (LAT1I). A terminal for a decentralized driving order assigning data signal (E_IN) to be inputted into the M/N bit shift register performs a controlling operation for making determination as to which recording element in a block should be driven, in cooperation with a clock terminal (ECLK) which serves to transfer the decentralized driving order assigning data signal (E_IN) to the recording means. For example, it is assumed that the number of bits to be simultaneously driven is selected in the order of 1, 9, 17, 25, and so on. In this case, it is sufficient that the data signal (E_IN) is set to first and ninth rising points in response to a clock signal to be inputted into the ECLK terminal. Usually, recording elements start to be driven from a 1st bit position, a 9th bit position, or other appropriate positions in the controlling unit. Then a 2nd bit position, a 10th bit position, or other appropriate positions in the controlling unit is driven, and subsequently a 3rd bit position, an 11th bit position, or other appropriate positions in the controlling unit is driven. Finally, an 8th bit position, a 16th bit position, or other appropriate positions in the controlling unit is driven to complete a single driving operation for the number M of recording elements. Accordingly, signals are inputted into the controlling unit in accordance with the timing charts shown in the drawing to complete a single driving operation for the number M of recording elements. When this construction is utilized, each decentralized driving operation can be achieved in response to only three signals represented by E_IN, ECLK and LAT2I irrespective of the total number M of recording elements without any occurrence of a malfunction that the number of terminals is undesirably increased. In the case that recording properties of the recording means inclusive of properties of the recording elements have bias such as density fluctuation, warpage or the like, the recording state of the recording apparatus can be improved by modifying the signal represented by E_IN such a manner as to compensate the foregoing bias. In addition, it is possible to employ a method of modifying the signal represented by E_IN corresponding to the direction of displacement of a carriage in the recording apparatus.

Figure 7:
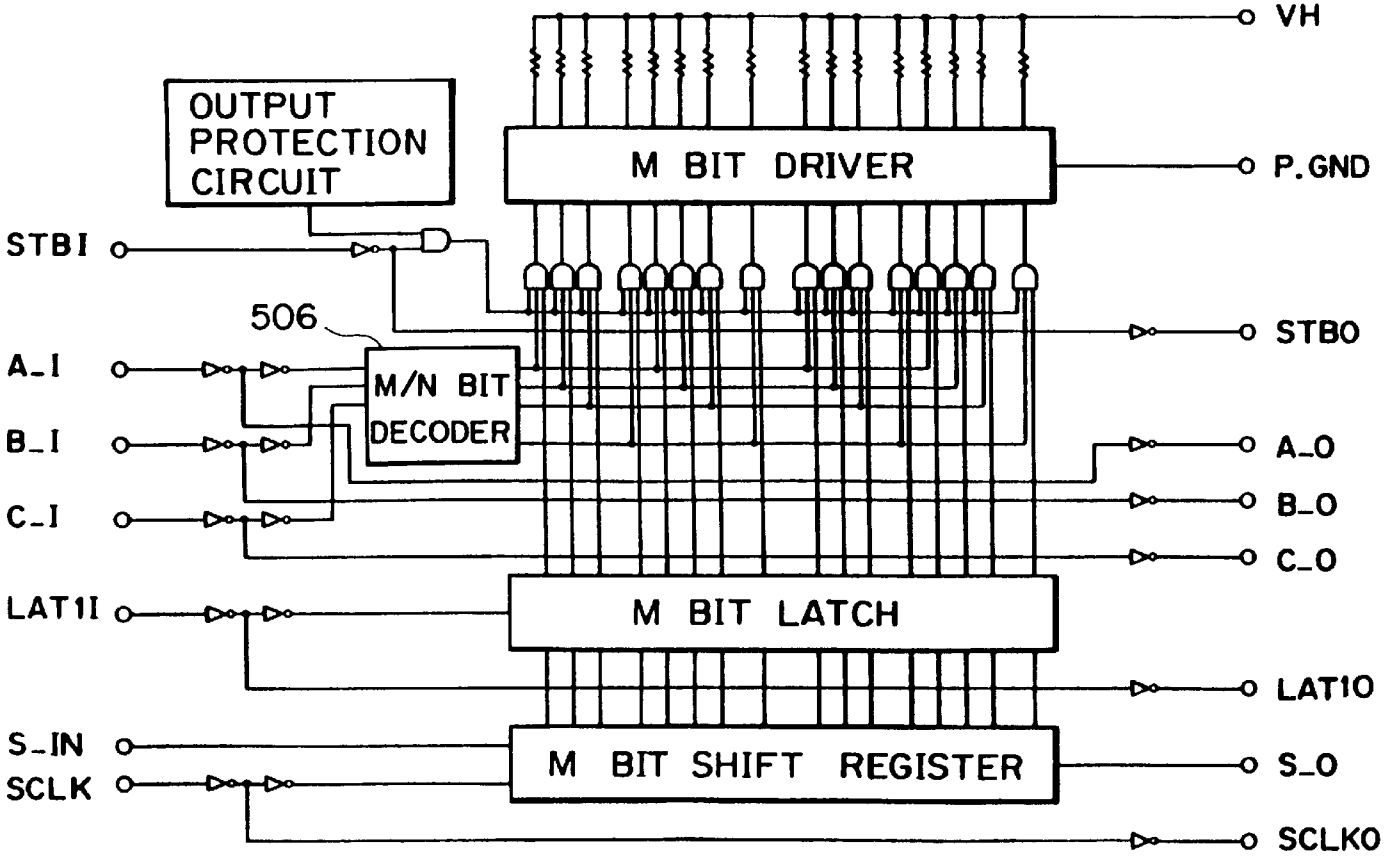
FIG. 7 is another-block diagram which illustratively explains the circuit structure for the recording means constructed in accordance with the embodiment of the present invention.

On the other hand, as shown in FIG. 7, in the case that the number of recording elements to be simultaneously driven among the total number M of recording elements disposed in the recording means is set to N means for achieving a decentralized driving operation may be constructed in the form of a decoder 5006 having an output represented by MIN bits. Signal inputting can be executed in response to three signals if a value of M/N is eight or less, although the execution of signal inputting varies depending on the value of M/N. The relationship between the value of M/N and the number T of terminals is represented by the following equation (I) from the viewpoint of construction of the decoder 506.

$$M/N=2^T \quad \text{(I)}$$

(where if T is set to tour, a decentralized driving operation can be achieved by a quantity corresponding to 16 bits.)

In contrast with the structure of a conventional recording apparatus having an increased number of enable terminals, according to the present invention, each decentralized driving operation can be achieved with a reduced number of signal inputting terminals.

Figure 8:
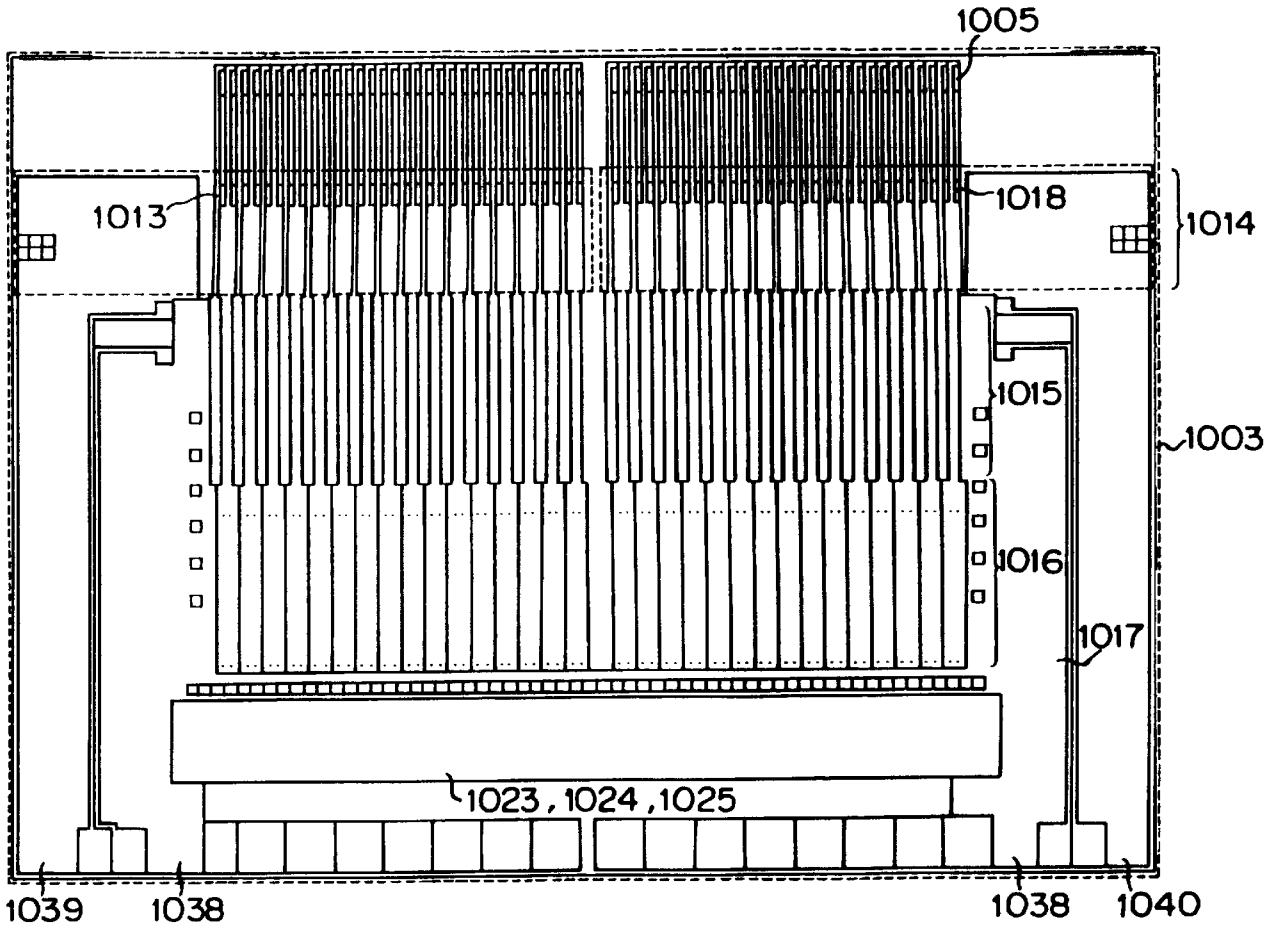
FIG. 8 is a schematic fragmentary enlarged plan view which illustratively explains the structure of a base board for recording means constructed in accordance with other embodiment of the embodiment of the present invention.

In addition, it is possible to construct a color recording apparatus having the aforementioned advantageous effect by serially inputting data representing an image formed with plural kinds of colors into the controlling unit when an image data signal S_I is inputted into the controlling unit. The foregoing type of color recording apparatus is exemplified in FIG. 8. Specifically, FIG. 8 is intended to illustratively explain the structure of a base board disposed in recording means equipped for an ink jet recording apparatus constructed in accordance with another embodiment of the present invention.

Provided that a common electrode is divided into two parts, i.e., a plurality of second layer conductors 1013 and a plurality of VH conductors 1014 and a different magnitude of voltage is then applied to each of the conductors 1013 and 1014, it is possible to change an intensity of electricity to be fed to each recording element corresponding to properties of recording elements assigned to each color. With such construction, since it becomes possible to feed electricity to the recording elements based on the image data for a time corresponding to the period of a latch pulse signal represented by LAT1I when a decentralized driving operation is performed for a block of recording elements corresponding to each color, it is possible to drive the recording apparatus with a pulse width corresponding to properties of each color merely by preparing terminals for strobe signals (STBI) of which number is coincident with that of colors employed for the color recording apparatus.

Figure 9:
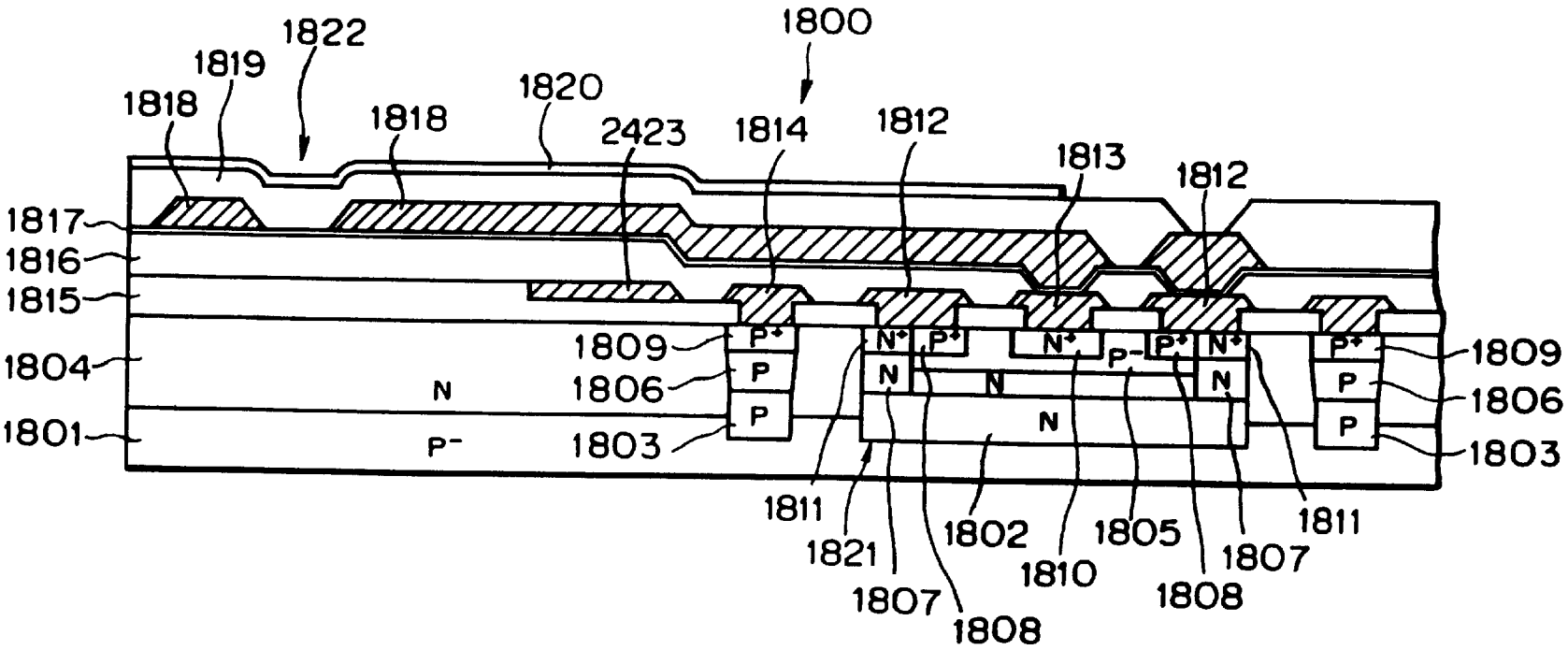
FIG. 9 is a schematic fragmentary enlarged sectional view which illustratively explains the structure of the base, board for the recording head constructed in accordance with the embodiment of the present invention.

FIG. 9 is a schematic fragmentary enlarged sectional view which illustratively shows the structure of a substrate for a recording head produced in accordance with the embodiment of the present invention.

The substrate 1800 for a recording head is substantially composed of a heat generating resistor layer 1817, a conductor electrode 1818 and protective films 1819 and 1820 and includes a heat generating portion 1822. A plurality of electrothermal transducers and a bipolar type NPN transistor 1821 serving as a functional element for each driving operation are formed on a P type silicon substrate 1801.

In FIG. 9, reference numeral 1801 designates a P type silicon base board, reference numeral 1802 designates a range where an N type collector is embedded for the purpose of constituting a functional element, reference numeral 1803 designates a range where P type isolators are embedded for the purpose of separating functional elements, reference character 1804 designates an N type epitaxial range, reference numeral 1805 designates a P type base range for constructing a functional element, reference numeral 1806 designates a range where P type isolators are embedded for the purpose of separating functional elements, reference numeral 1807 designates a range where N type isolators are embedded for the purpose of constituting a functional element, reference numeral 1808 designates high density P type base ranges each serving for constituting a functional element, reference numeral 1809 designates high density P type isolation ranges each serving for separating a functional element, reference numeral 1810 designates an N type emitter range for constituting a functional element, reference numeral 1811 designates high density N type collector ranges each serving for constituting a functional element, reference character 1812 designates collector/base common electrodes, reference numeral 1813 designates an emitter electrode, and reference numeral 1814 designates an isolation electrode. In addition, an NPN transistor 1821 is formed in the substrate 1800, and moreover, a collector range designated by reference numerals 1802, 1804, 1807 and 1811 is formed in the substrate 1800 in such a manner as to completely surround the emitter range 1810 and the base ranges 1805 and 1808 therewith. Further, each cell is surrounded by the P type isolator embedding range 1806, the P type collector embedding range 1808 and the high density P type isolation range 1809, causing the cell to be electrically separated from the substrate 1800 along the element separating range.

Here, the NPN transistor 1821 is constructed by the two high density N type collector ranges 1811 formed on the P type silicon base board 1801 via the N type collector embedding range 1802 and the N type collector embedding range 1807, the two high density P type base ranges 1808 formed inside of the high density N type collector range 1811 via the N type collector embedding range 1802 and the P type base range 1805, and the high density N type emitter range 1810 formed with the high density P type base ranges 1808 located on the opposite sides thereof via the N type collector embedding range 1802 and the P type base range 1805 to exhibit the structure of the NPN transistor 1821. However, since the high density N type collector ranges 1811 and the high density P type base ranges 1808 are electrically connected to each other via the collector/base common electrodes 1812, the NPN transistor 1821 operates as a diode. In addition, the P type isolator embedding ranges 1803, the P type isolation ranges 1806 and the high density P type isolation ranges 1809 are successively formed adjacent to the NPN transistor 1821 to serve as element isolation ranges. Additionally, the heat generating layer 1817 is formed on the P type silicon base board 1801 via the P type epitaxial ranges 1809, a heat accumulating layer 1815 and an interlaminar film 1816 formed integral with the heat accumulating layer 1815 to serve also as a heat accumulating layer. A heat generating portion 1822 is constructed by cutting the conductor electrode 1818 formed on the heat generating layer 1817 into two parts, causing the heat generating portion 1822 to be formed between two edge portions 1819 of the foregoing cut parts.

The whole surface of the substrate 1800 for a recording head is covered with the heat accumulating layer 1815 formed by a thermally oxidized film or the like, and each of the electrodes 1812, 1813 and 1814 associated with the functional elements is formed using aluminum or the like.

In this embodiment, the substrate 1800 is constructed such that the collector/base common electrodes 1812, the emitter electrode 1813 and the isolation electrode 1814 are formed on the P type silicon base board 1801 for the recording head including a driving portion (functional elements) as mentioned above, and moreover, the P type silicon base board 1801 is covered with the heat accumulating layer 1815. In addition, the interlaminar film 1816 composed of a silicon based compound such as SiO, $SiO_2$, SiN, SiON or the like is formed above the heat accumulating layer 1815 by employing a normal pressure CVD process, a PCVD process, a spattering process or the like. Since each of the electrodes 1812, 1813 and 1814 made of a metallic material such as aluminum or the like has opposite inclined side surfaces, the interlaminar film 1816 exhibits very excellent step coverage properties. Thus, in contrast with the conventional recording apparatus, according to the present invention, the interlaminar film 1816 having a small thickness can be formed without any occurrence of a malfunction that it loses a heat accumulating effect. A part of the interlaminar film 1816 is opened in the form of holes which allow the electrode 1818 to be electrically connected to the collector/base common electrode 1812, the emitter electrode 1813 and the isolation electrode 1814. In addition, to assure that a wire-like electrical conductive material extends across the interlaminar film 1816, the conductor electrodes 1818 are each made of a metallic material such as aluminum or the like are placed on the interlaminar film 1816. Specifically, after a part of the interlaminar film 1816 is opened in the form of holes, the heat generating resistor layer 1817 made of TaN or the like is deposited on the interlaminar film 1816 by employing a reactive spattering process, and moreover, the layer 1817 which forms the electrothermal transducers and the conductor electrodes 1818 which are each made of a metallic material such as aluminum or the like are disposed on the interlaminar film 1816 by employing a vacuum depositing process or a spattering process. Here, a material employable for constituting the heat generating resistor layer 1817 is exemplified by a metallic material having a high melting temperature such as Ta, W, Mo or the like, a nitride of the foregoing metallic material and a carbide of the same each of which can serve as a resistor.

Incidentally, in this embodiment, a film of tantalum nitride was used as the heat generating resistor layer 1817.

Figure 10:
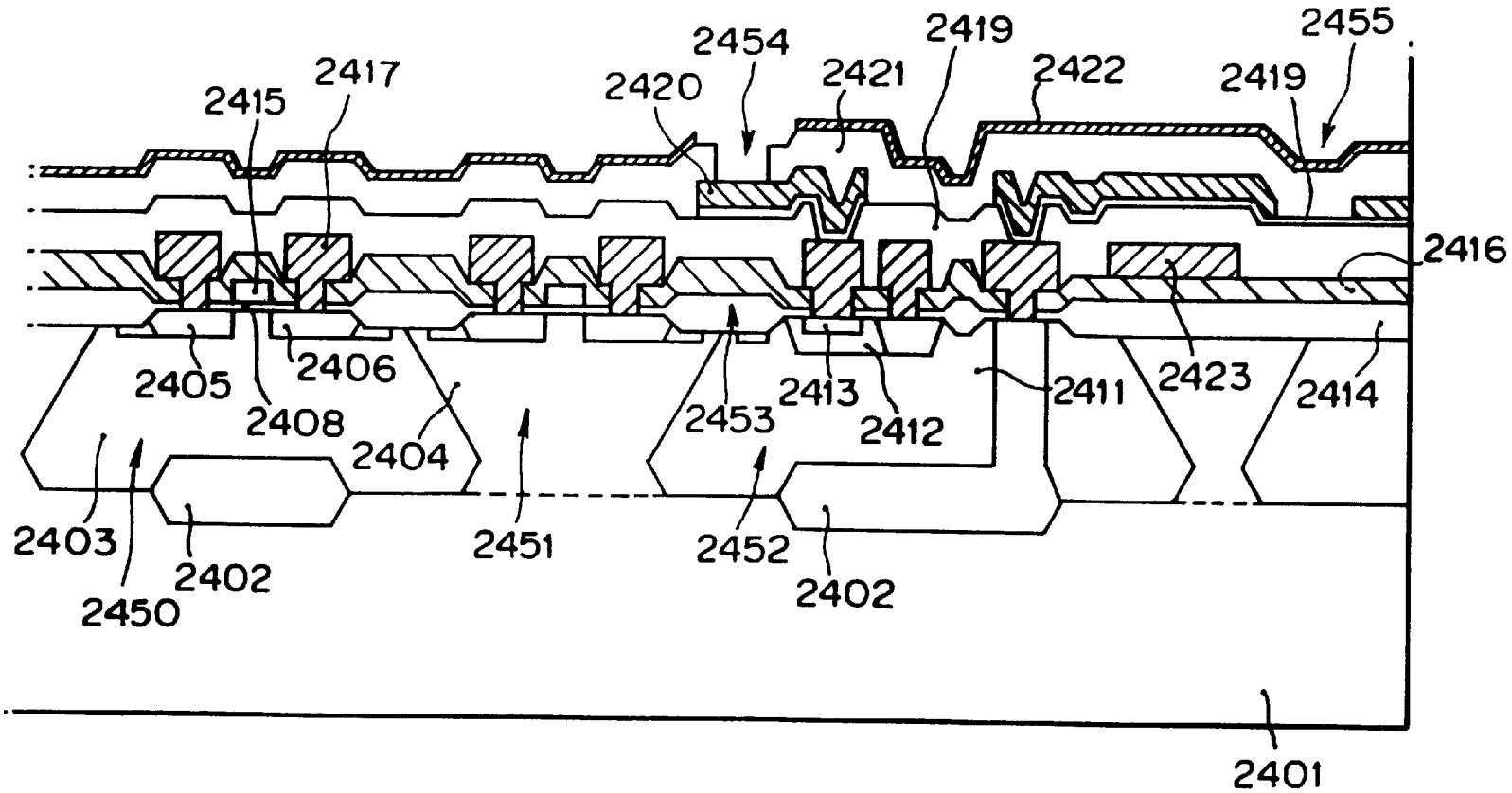
FIG. 10 is a schematic fragmentary enlarged sectional view which illustratively explains one step of producing a substrate for a recording head in accordance with the embodiment of the present invention.

A series of steps of producing a substrate in accordance with the embodiment of the present invention will be described below with reference to FIG. 10 that is a schematic fragmentary enlarged sectional view which illustratively shows that the substrate is cut across essential components and FIG. 11A, FIG. 11B and FIG. 11C that are schematic fragmentary enlarged sectional views which illustratively show a series of steps of producing a substrate, respectively.

A dopant such as or the like is introduced into a P type electrical conductive silicon base board 2401 by employing an ion implantation process, a dispersion process or the like in order to form an N type embedding layer 2402 on the base board 2401, and subsequently, an N type epitaxial layer 2403 having a thickness of 5 to 10 $\mu$m is formed above the N type embedding layer 2402. In addition, an impurity such as B or the like is introduced into the epitaxial layer 2403 in order to form a P type well range 2404. Thereafter, the impurity is repeatedly introduced into the epitaxial layer 2403 by employing a photolithography process, an oxidizing/dispersing process, an ion plantation process or the like, whereby a PMOS 2450 is formed in an N type epitaxial range and an NMOS 2451 is formed in a P type well range. Each of the PMOS 2450 and the NMOS 2451 includes a gate conductor 2415 having a polysilicon deposited thereon with a thickness of 4000 to 5000 Å via a gate electrical insulative film 2408 having a thickness of several hundred angstroms by employing a CVD process. In addition, it includes a source range 2405 and a drain range 2406 into which an N type or P type impurity is introduced.

An NPN transistor 2452 to serve as a power transistor is substantially composed of a collector range 2411, a base range 2412 and an emitter range 2413 in an N type epitaxial layer by way of steps of introduction and dispersion of impurities in the NPN transistor 2342.

An oxidized film separating range 2453 is formed in the NPN transistor 2452 by subjecting respective elements to field oxidizing by a quantity of 5000 to 10,000 Å, whereby the respective elements are separated from each other.

The resultant field-oxidized film serves as a first heat accumulating layer 2414 below a heater heat generating portion 2455.

Figure 11A:
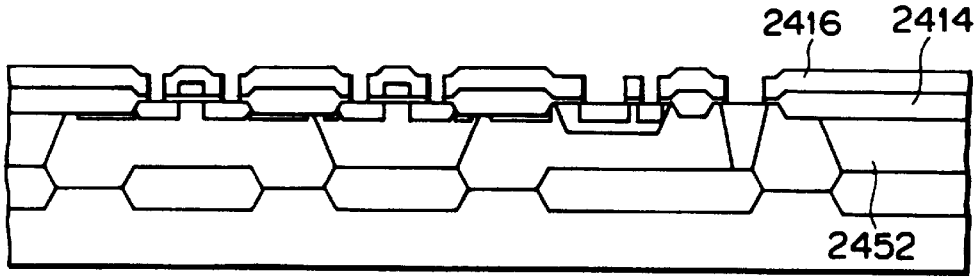
FIG. 11A, FIG. 11B and FIG. 11C are schematic fragmentary enlarged sectional views which illustratively explain a series of steps of producing a substrate for a recording head in accordance with the present invention, respectively.

After the respective elements are formed in that way, an interlaminar electrical insulative film 2416 is deposited thereon by a thickness of about 7000 Å with the aid of PSG, BPSG or the like by employing a CVD process, whereby contact holes are formed on the respective elements while they are subjected to flattening treatment by heat-treating them (see FIG. 11A).

Figure 11B:
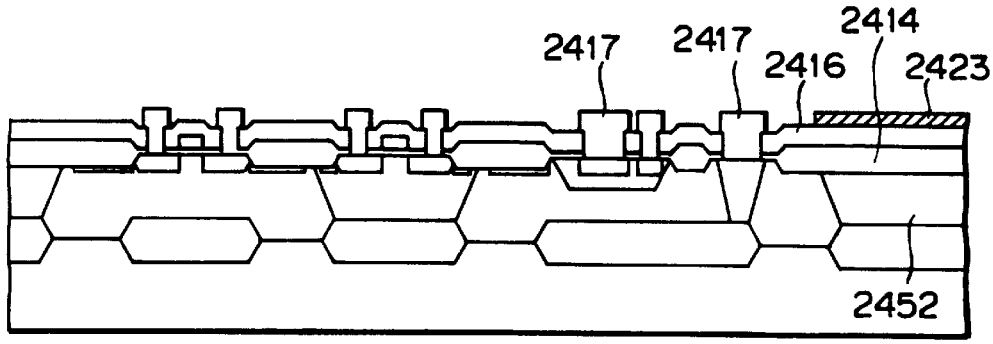
Figure 11C:
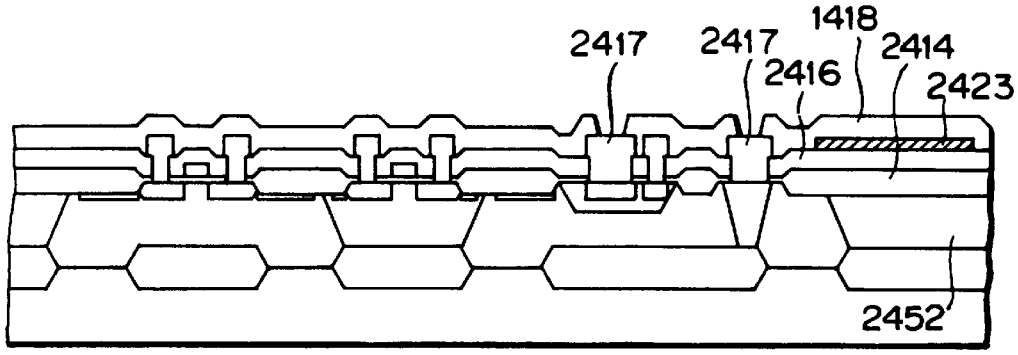

Next, conductors 2417 for the respective functional elements arc prepared by forming an aluminum layer via the contact holes, and at the same time, a conductor VH 2423 for a heat generating resistor element is formed on the heat accumulating layer 2414 (see FIG. 11B). Consequently, a yielding rate of the recording apparatus can be improved by a quantity corresponding to the reduced number of film forming operations.

Thereafter, an interlaminar electrical insulative film 2418 composed of SiO or a similar material is deposited on the conductor VH 2423 with a thickness of 10,000 to 15,000 Å by employing a plasma CVA process in the same manner as that explained in the above description (see FIG. 11C), whereby a heat generating resistor layer 2419 composed of TaN is formed with a thickness of about 1000 Å via the through holes by employing a DC spattering process.

Next, a contact hole is formed through a part of the electrical insulative film 1418 on the VH conductor 1423, and thereafter, a second layer aluminum conductor is formed by employing a spattering process. A protective film 2421 composed of SiN is formed with a thickness of about 10,000 Å by employing a plasma CVD process via two step film formation executed first within the temperature range of 200° C. to 300° C., and subsequently, within the temperature range of 350° C. to 450° C.

A cavitation resisting film 2422 composed of Ta or a similar material is deposited as an uppermost layer with a thickness of about 2000 Å, and a pat portion 2454 is formed through the cavitation resisting film 2422.

Finally, an intermediate product of substrate prepared by way of the aforementioned steps is annealed in an atmosphere of $H_2$ at a temperature of about 400° C., whereby the production of a substrate for a recording head is completed.

The final annealing step is effective for improving properties of the substrate in respect of contact between the metallic material of aluminum and the silicon base board, and moreover, restoring each element damaged during heat treatment, plasma treatment or the like to assume its original state.

After completion of the production of the substrate for a recording head, the substrate is used as a basic material for providing a recording head including a plurality of nozzles each serving to eject ink therefrom in the same manner as another embodiment of the present invention.

In this embodiment, the power transistor is constructed in the form of a bipolar transistor. Alternatively, it may be constructed in the form of a MOS transistor.

Figure 12:
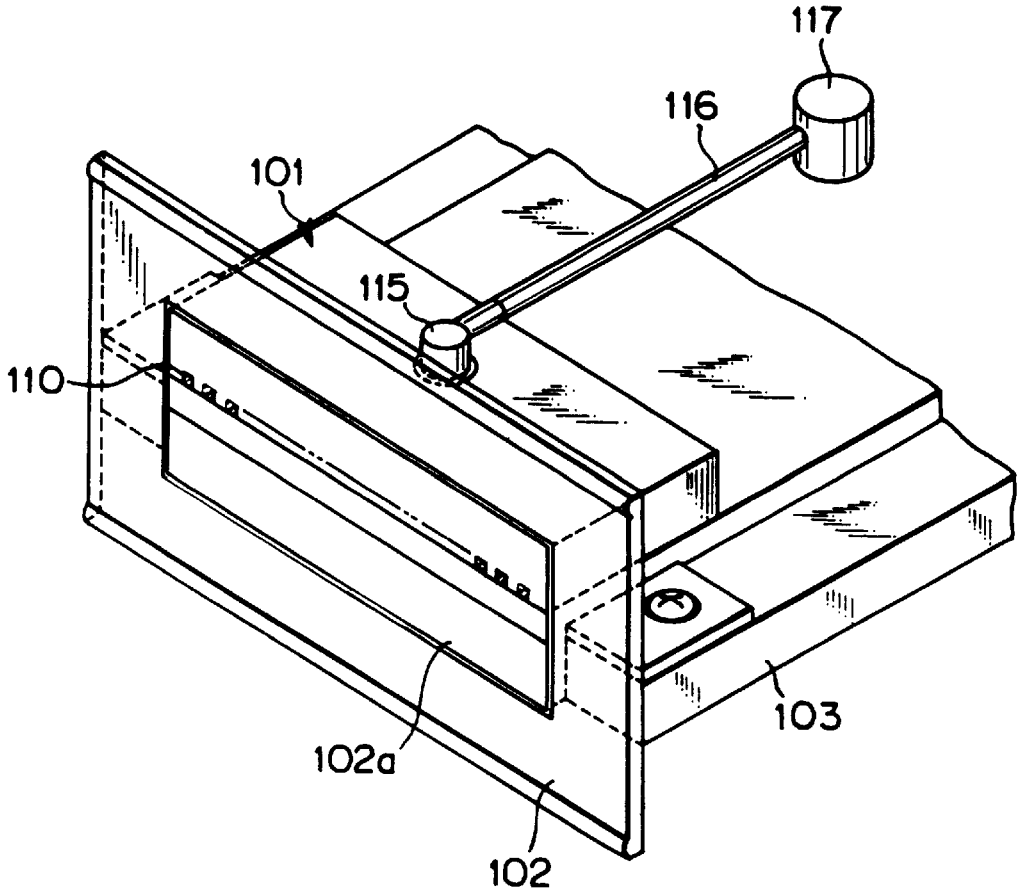
FIG. 12 is a schematic perspective view which illustratively explains the arrangement of a plurality of ink ejecting ports and peripheral components of the latter arranged in an ink jet recording apparatus to which the present invention can be applied.

FIG. 12 is a schematic perspective view which illustratively explains by way of example the structure of ink jet recording means for which the base board constructed in the above-described manner is used. In the drawing, reference numeral 101 designates an ejecting element. The ejecting element 101 includes a plurality of ink flow paths each having an electrothermal transducer (recording element) disposed therein for generating thermal energy to be utilized for ejecting ink therefrom, a plurality of ejection ports 110 exposed to the outside at the foremost ends of the ink flow paths, and a common liquid chamber for storably receiving ink fed to the respective ink flow paths so as to form an image by ejecting ink from the ejection ports 110. Reference numeral 103 designates a base plate for immovably holding the ejecting element 101 using an adhesive, and reference numeral 102 designates a front plate fixedly secured to the foremost end of the base plate 103. To assure that the ejection ports 110 face directly to a recording medium (not shown), an opening portion 102*a* is formed through the front plate 102. In addition, reference numerals 115, 116 and 117 designates members each constituting a part of the ink feeding system. Additionally, reference numeral 115 designates a joint member by way of which ink is introduced into the common liquid chamber in the ejecting element 101, reference numeral 117 designates a filter unit disposed at the intermediate position of an ink feeding path extending from an ink tank or the like to serve as an ink supply source, and reference numeral 116 designates a feeding tube for connecting the joint member 115 to the filter unit 115 while extending therebetween.

Figure 13:
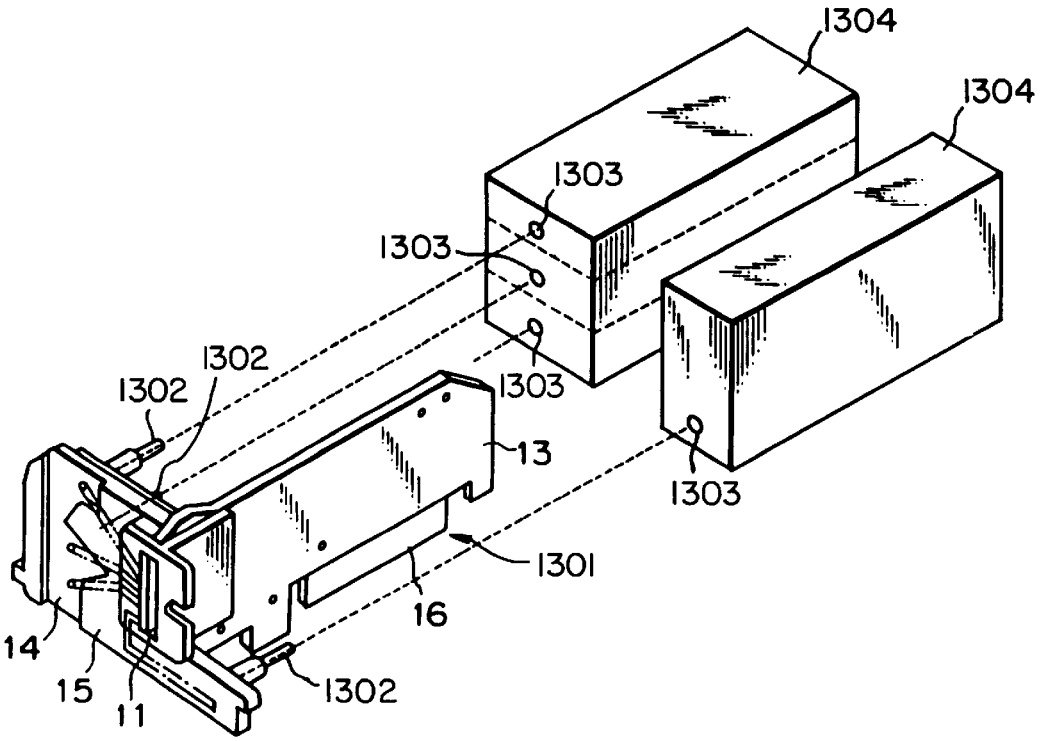
FIG. 13 is a schematic perspective view which illustratively explains the structure of a color ink jet recording apparatus to which the present invention can be applied.

FIG. 13 is a schematic perspective view which illustratively explains the structure of recording means detachably mounted on a carriage in an ink jet recording apparatus. In the drawing, reference numeral 1301 designates an ink jet recording head for ejecting ink therefrom based on image data, reference numeral 1302 designates a plurality of ink feeding tubes, and reference numeral 1304 designates an ink cartridge. As is apparent from the drawing, ink feeding ports 1303 formed on the ink cartridges 1304 are located in alignment with the ink feeding tubes 1302.

The ink cartridge 1304 located on the right-hand side of the drawing serves to storably receive black-colored ink therein, while the ink cartridge 1304 located on the left-hand side of the same includes three cartridge segments in which three kinds of colored-inks (i.e., cyan-colored ink, yellow-colored ink, magenta-colored ink) are storably received.

The ink jet recording head 1301 is constructed in the following manner.

As shown in the drawing, four arrays of ejecting ports each designated by reference numeral 11 are arranged such that a plurality of ejecting ports are located along a single straight line so as to allow cyan-colored ink, yellow-colored ink, magenta-colored ink and black-colored ink to be ejected therefrom. A plurality of recording elements corresponding to the ejecting ports are arranged on a base board 1003 as shown in FIG. 3, and the number M of recording elements can be increased or reduced depending on the required number of ejecting ports. Provided that the number m of base boards 1003 are cascade-connected to each other, it is assured that ink can be ejected from the ink jet recording head 1301 based on image data corresponding to the number of recording elements represented by M×m.

Among the four arrays 11 of ejecting ports for cyan-colored ink, yellow-colored ink, magenta-colored ink and black-colored ink, a plurality of ejecting ports corresponding to each color are communicated with ink flow paths which in turn are communicated with a common liquid chamber at the position behind the ink flow paths so as to allow the ink to be fed to the respective ink flow paths from the common liquid chamber. These components are firmly placed on the base board 1003 with the aid of partition walls, ceiling plates or the like in conformity with a hitherto known method to form a laminated structure therewith.

In addition, a printed base board-like member having a plurality of signal line conductors laid thereon for driving a plurality of integrated circuits is disposed behind the foregoing components, and a terminal portion 16 is electrically connected to a connector on the carriage. The base board 1003 and the printed base board-like member are fixedly secured to a base plate 13 made of a metallic material such as aluminum or the like.

The ink cartridge 1304 are inserted into the ink jet recording head 1301 with an attitude substantially in parallel with the base plate 13 until the ink feeding tubes 1302 rearwardly projecting in parallel with the base plate 13 are fitted into the ink feeding ports 1303 on the ink cartridges 1304. The ink feeding tubes 1302 are projected from a distributor 14 molded of a plastic material and extending in the normal direction relative to the base plate 13, and moreover, they are communicated with a plurality of ink flow paths 15 formed in the distributor 14 which in turn are communicated with the common liquid chamber.

In practice, four ink flow paths 15 are formed in the distributor 14 corresponding to cyan-colored ink, yellow-colored ink, magenta-colored ink and black-colored ink so that a common liquid chamber for each colored ink is communicated with the ink feeding tube 1302 via the corresponding ink flow path 15. Since the ink cartridges 1304 are distributively arranged such that one of them located on the left-hand side relative to the base plate 13 is used for three colored inks (i.e., cyan-colored ink, yellow-colored ink, magenta-colored ink) and the other one located on the right-hand side relative to the same is used for black ink, three ink feeding tubes 1302 are projected from the distributor 14 on the left-hand side and one ink feeding tube 2 is projected from the same on the right-hand side.

Figure 14:
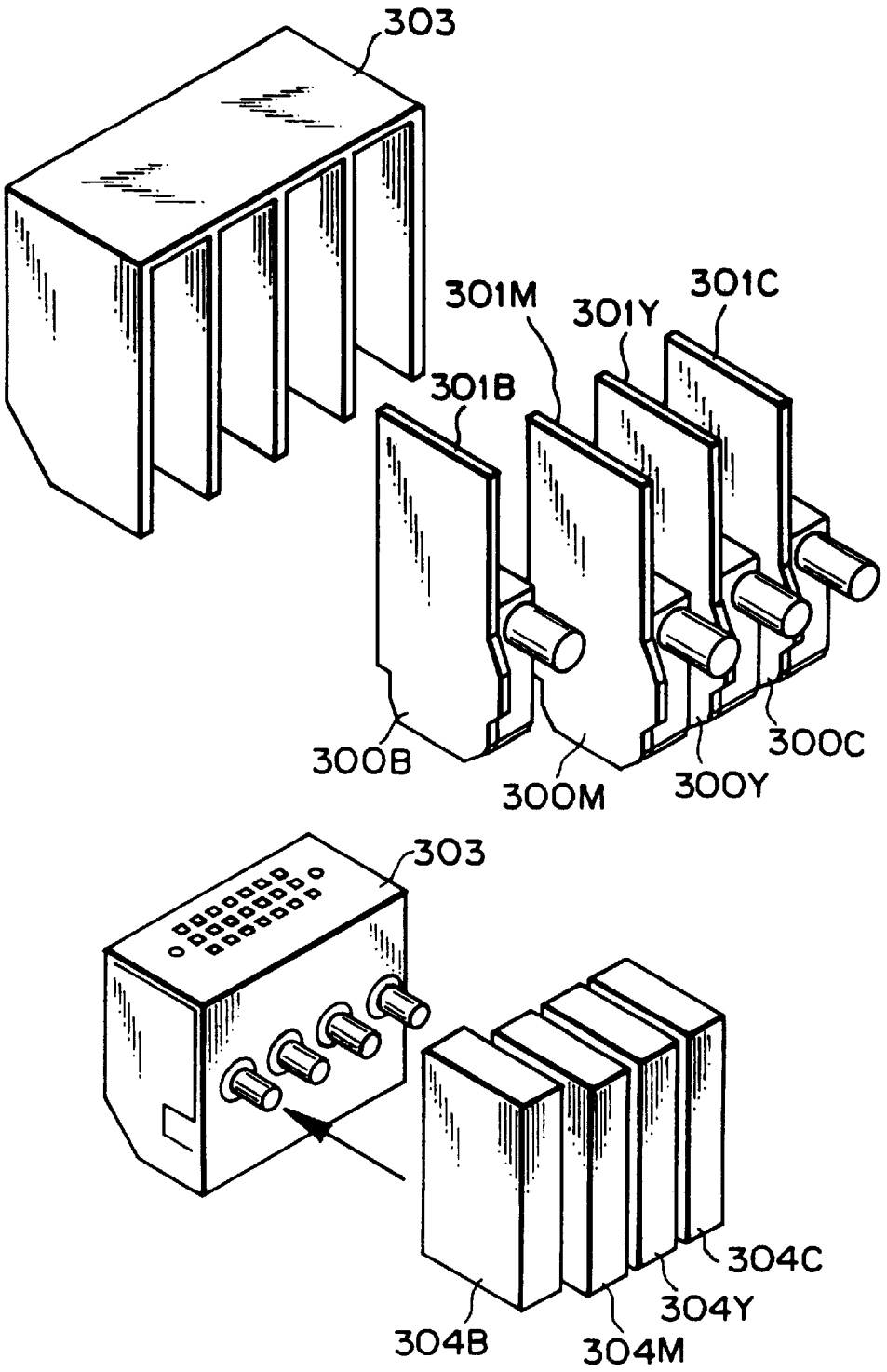
FIG. 14 is a schematic perspective view which illustratively explains the structure of a color ink jet recording apparatus constructed in accordance with another embodiment of the present invention, showing essential components constituting the color ink jet recording apparatus in the disassembled state.

FIG. 14 is a schematic perspective view which illustratively explains the structure of an ink jet recording apparatus constructed in accordance with another embodiment of the present invention wherein ink jet recording means for respective colored inks are cascade-connected to each other so as to enable each printing operation to be achieved at a high speed.

Connection terminal pads 301C, 301Y, 301M and 301B for ink jet recording means 300C, 300Y, 300M and 300B operable corresponding to respective colored inks are cascade-connected to each other by actuating a connecting member 303. This connecting member 303 includes a common power source terminal. In addition, to assure that conductor terminals for signal lines are cascade-connected to each other, a printed base board having conductors laid thereon and other components are involved in the connecting member 303. With this construction, a single ink jet recording apparatus is provided while the ink jet recording means 300C, 300Y, 300M and 300B are cascade-connected to each other by actuating the connecting member 303. After ink tank cartridges 304C, 304Y, 304M ad 304B corresponding to the ink jet recording means 300C, 300Y, 300 M and 300B are connected to an assembly of the ink jet recording means 300C, 300Y, 300M and 300B, ejection of the inks corresponding to the respective colors can be started.

Figure 15:
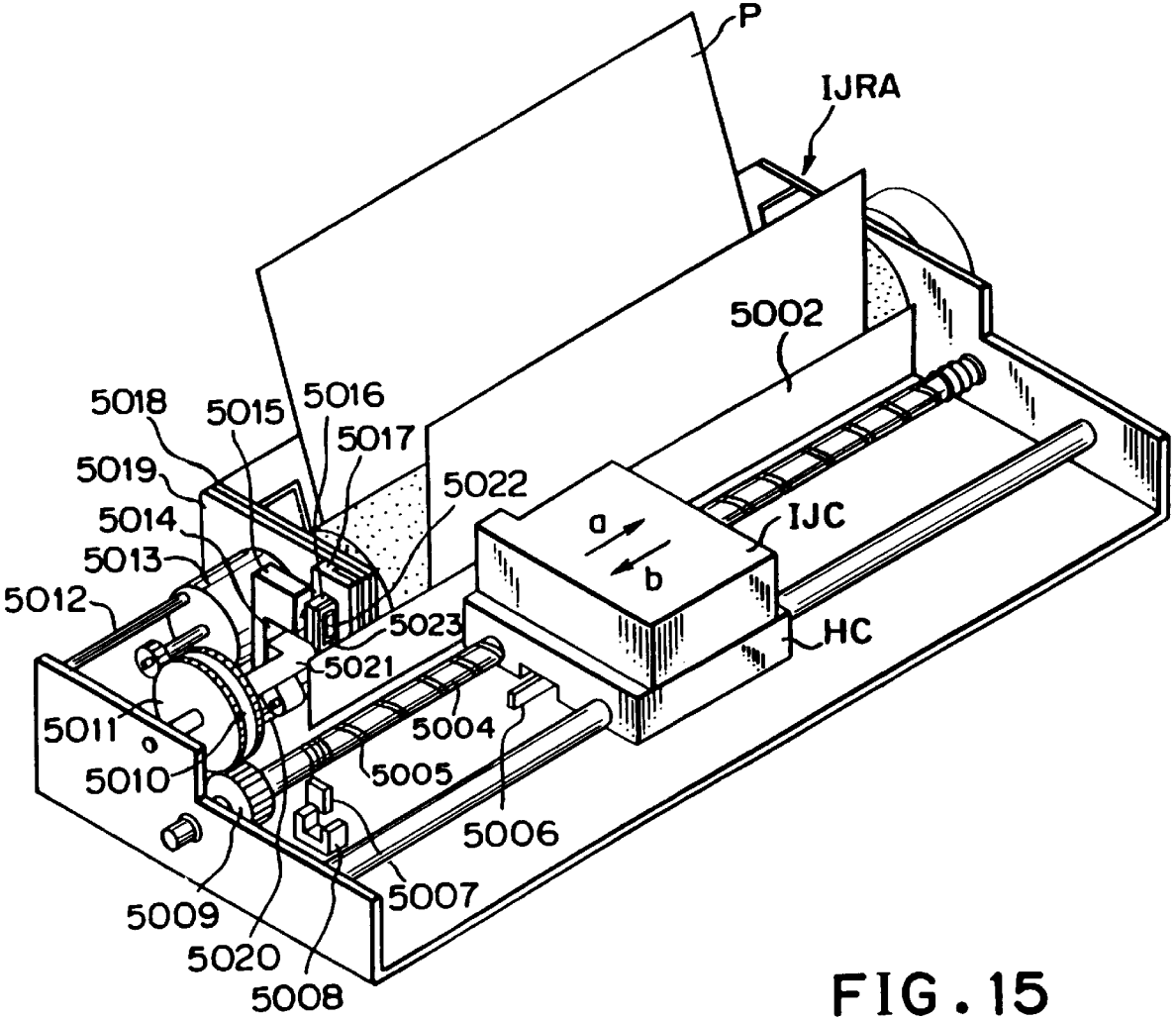
FIG. 15 is a schematic perspective view which illustratively explains the structure of a serial type printer on which recording means constructed in accordance with the embodiment of the present invention can be mounted.

FIG. 15 is a perspective view of an ink jet recording apparatus IJRA which illustratively shows an appearance of the latter. As a driving motor 5013 is rotationally driven in the normal/reverse direction, the rotational force of the driving motor 5013 is transmitted to a lead screw 5005 via driving force transmitting gears 5011 and 5009, causing a carriage HC operatively engaged with the lead screw 5005 via a spirally extending groove 5004 to be reciprocably displaced in the a/b arrow-marked direction. In the drawing, reference numeral 5002 designates a paper retaining plate which serves to thrust a sheet of paper P against a platen across the width of the paper retaining plate 5002 as measured in the direction of displacement of the carriage HC. Reference numerals 5007 and 5008 designate photocouplers which serve as home position detecting means for changing the direction of rotation of the driving motor 5013 by confirming the presence of a lever 5006 of the carriage HC. Reference numeral 5016 designates a member for supporting a cap member 5022 for capping the front surface of an ink jet recording head therewith, and reference numeral 5015 designates sucking means for evacuating the interior of the cap member 5022. The sucking means 5015 sucks air through an opening portion 5023 of the cap member 5022 so as to recoverably activate the ink jet recording head. Reference numeral 5017 designates a cleaning blade, and reference numeral 5019 designates a member which makes it possible that the cleaning blade 5017 is displaced in the forward/rearward direction. The cleaning blade 5017 and the member 5019 are supported by a housing supporting plate 5018. The cleaning blade 5017 should not be limited only to the shown type. It of course is obvious that other type of hitherto known cleaning blade rather than the foregoing one is applicable to this embodiment. In addition, reference numeral 5012 designates a lever for starting a suction operation so as to recoverably activate the ink jet recording head. As a cam 5020 operatively engaged with the carriage HC is displaced, the lever 5012 is followably displaced to control the transmission of the rotational driving force of the driving motor 5013 to the lead screw 5005 via hitherto known force transmitting means such as a clutch or the like.

The ink jet recording apparatus is constructed such that a capping operation, a cleaning operation and a sucking/recoverable activating operation can be performed at the predetermined positions with the aid of the lead screw 5005 when the carriage HC enters the home position range. However, provided that the ink jet recording apparatus is constructed such that any one of the aforementioned operations can be achieved in the hitherto known timing relationship, any type of construction may be applied to this embodiment.

When a predetermined number of recording elements, functional elements and driving integrated circuits are actually installed on a base plate corresponding to the recording width represented by one line or they are structurally disposed in the interior of the same base board from the viewpoint of keeping the ink jet recording apparatus in the maintenance-free state, the present invention can provide a full line ink jet recording apparatus which has high reliability and assures that each printing operation can be performed not only at a high density but also at a high speed.

Figure 16:
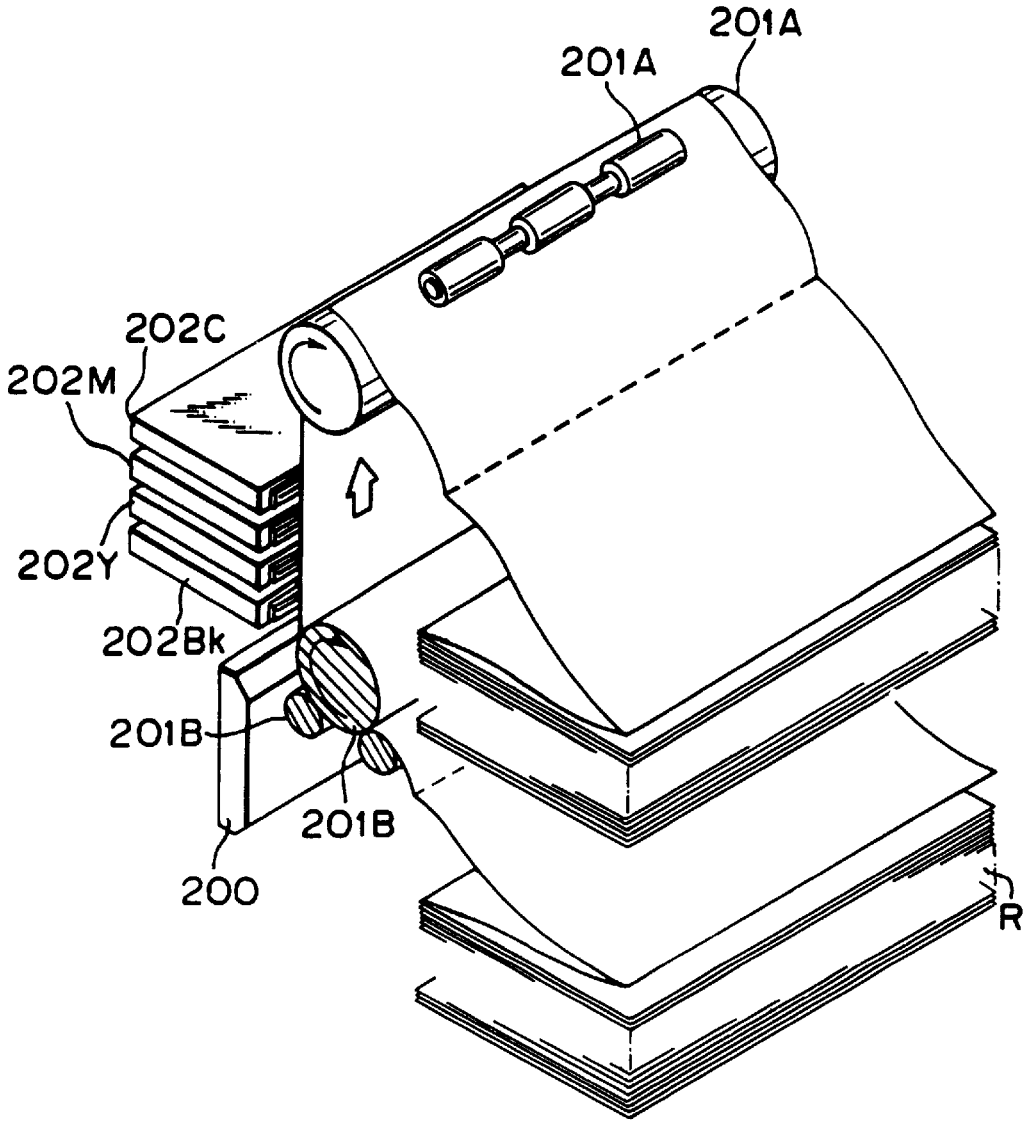
FIG. 16 is a schematic perspective view which illustratively explains the structure of a line printer on which recording means constructed in accordance with the embodiment of the present invention can be mounted.

FIG. 16 is a schematic perspective view which illustratively explains the structure of a full color recording apparatus which assures that a high quality of colored image can be recorded on a recording medium using four kinds of colored inks, i.e., cyan-colored ink, yellow-colored ink, magenta-colored ink and black-colored ink wherein a predetermined number of recording elements, functional elements and driving integrated circuits corresponding to several tens of recording units are actually installed on a base plate or they are structurally disposed in the interior of the same base board in order to constitute a full line ink jet recording apparatus. In the drawing, reference numerals 201A and 201B designate a pair of rollers which serve as conveying means for conveying a recording medium R while the latter is held in the auxiliary scanning direction Vs by the pair of rollers 201A and 201B in the clamped state. Reference numerals 202B, 202Y, 202M and 202B designate full line type ink jet recording units adapted to perform a color recording operation using four kinds of colored inks, i.e., black-colored ink, yellow-colored ink, magenta-colored ink and cyan-colored ink with the aid of a plurality of nozzles disposed in the side-by-side relationship across the full width of the recording medium R. The full line type ink jet recording units 202B, 202Y, 202M and 202C are arranged in the order of black, yellow, magenta and-black as seen from the upstream side in the direction of conveyance of the recording medium R to construct a recording unit assembly. Reference numeral 200 designates ejecting/recovering means which faces to the recording unit assembly but not to the recording medium R. To execute ejecting/recovering treatment, the ejecting/recording means 200 includes a cap, an ink absorbing member and a wiping blade.

As described above, the recording apparatus of the present invention includes a common electrode for feeding electricity to a plurality of recording elements simultaneously formed during a process for forming a metallic film extending from the dispersed layer constituting a driving integrated circuit placed on a base board. In addition, the common electrode for feeding electricity to the recording elements is electrically connected to another metallic film formed above the first-mentioned metallic film during another process via an electrical insulative layer and through holes. With this construction, when the recording apparatus is to be produced, it is required that a firm forming process of forming a plurality of recording elements and a conductor portion and a step of forming a metallic film for the conductor portion are once executed. In addition, the driving integrated circuit including a plurality of functional elements in the substrate is few affected by the difference between the two processes. Consequently, a yielding rate of the recording apparatus can be improved by a quantity corresponding to the reduced number of film forming operations.

Further, provided that recording units each constructed in the above-described manner are cascade-connected to each other, the present invention can provide a recording apparatus which assures that each printing operation can be achieved not only at a high density but also at a high speed. This leads to the result that a color printer can practically be realized at a low cost.

Since the present invention assures that the recording apparatus exhibits advantageous effects as mentioned above, it is obvious that a utilization field and a degree of resolution of the recording apparatus should not be limited only to the aforementioned ones.

(Other embodiments)

Among various kinds of ink jet recording systems, the present invention is concerned with a recording head or a recording apparatus of the type which includes means for generating thermal energy (e.g., electrothermal transducers, a laser light beam or the like) to be utilized for ejecting ink therefrom, and moreover, causing the state of ink to vary by the thermal energy. According to such a system as mentioned above each recording operation can be achieved not only at a high density but also at a high accuracy while assuring distinct advantageous effects inherent to this system.

With respect to a typical structure and an operational principle of the foregoing system, it is preferable that reference is made to official gazettes of U.S. Pat. Nos. 4,723,129 and 4,740,796 each of which discloses a basic principle of the foregoing type of system. Although this system can be applied to either of a so-called on-demand type ink jet recording system and a continuous type jet recording system, it is particularly suitably employable for operating in the form of an on-demand type recording apparatus. This is because the on-demand type recording apparatus includes electrothermal transducers each disposed corresponding to a sheet of paper or a liquid path having liquid (ink) retained therein and operates in the following manner. In response to at least one driving signal applied to the electrothermal transducers to induce sudden temperature rise in excess of the appearance of a phenomenon of nucleate boiling in the liquid, thermal energy is generated in the electrothermal transducers, causing a phenomenon of film boiling to appear on the heating portions of a recording head. This leads to the result that gas bubbles are grown in the liquid (ink) corresponding to the driving signal. By using the growth and collapse of the gas bubbles, at least one liquid droplet is ejected from a plurality of ink ejecting nozzles. The drive signal in the form of a pulse is preferably employable because the growth and collapse of the gas bubbles can instantaneously be achieved, resulting in the liquid (ink) being ejected with excellent responsiveness. As driving signals to be outputted in the form of a pulse, those described in official gazettes of U.S. Pat. Nos. 4,463,359 and 4,345,262 are preferably employable. In addition, it is preferable that the rate of temperature rise of the heating portions of the recording head is employed to perform a more excellent recording operation.

With respect to the structure of the recording head, it is recommendable that reference is made to official gazettes of U.S. Pat. Nos. 4,558,333 and 4,459,600 both of which are incorporated in the present invention. According to these prior inventions, the structure including heating portions disposed on bent portions of the recording head in addition to a combination made among the ejecting ports, the liquid paths (linearly extending liquid flow paths or flow paths extending at a right angle relative to the preceding ones) and the electrothermal transducers disclosed in the aforementioned prior inventions is disclosed in the official gazettes the foregoing prior inventions. In addition, the present invention can advantageously be applied to the structure disclosed in an official gazette of Japanese Patent Laid-Open Publication NO. 59-123670 so as to allow a common slit to be used as ejecting portions for a plurality of electrothermal transducers. Additionally, the present invention can advantageously be applied to the structure disclosed in an official gazette of Japanese Patent Laid-Open Publication NO. 59-138461 so as to allow opening portions for absorbing pressure waves caused by the thermal energy to be used as ejecting ports. Thus, irrespective of the type of the recording head, the present invention assures that each recording operation can reliably be achieved at a high efficiency.

Further, the present invention can advantageously be applied to a full line type recording head having a length equal to the maximum width of a recording medium with which each recording operation can be performed by operating the recording apparatus This type of recording head is exemplified by a recording head having such a structure that a condition relating to the foregoing length is satisfied by combining a plurality of recording heads with each other and a single recording head having an integral structure.

Moreover, among various kinds of conventional serial type recording apparatuses exemplified in official gazettes of the aforementioned prior inventions, the present invention can advantageously be applied to a serial type recording head fixedly secured to a main body of the recording apparatus, an exchangeable tip type recording head which is electrically connected to the main body of the recording apparatus, and moreover, makes it possible to feed ink from the main body of the recording apparatus when the recording head is mounted on the latter, and a cartridge type recording head which is made integral with an ink tank.

With respect to the structure of the recording apparatus constructed according to the present invention, it is desirable that the recording apparatus is additionally equipped with ejecting/recovering means for the recording head and preliminary auxiliary means, because they serve to make the advantageous effects of the present invention more reliable. Concretely, capping means effective for capping the recording head therewith, cleaning means, pressurizing or sucking means, preliminary heating means including electrothermal transducers or heating elements or a combination of electrothermal transducers with heating elements so as to heat the recording head, and preliminary ejecting means can be noted as ejecting/recovering means and preliminary auxiliary means.

The kind and the number of recording heads to be mounted on the recording apparatus can be also changed as desired. For example, only one recording head corresponding to a monochromatic ink is acceptable. In addition, a plurality of recording heads corresponding to plural kinds or inks different in color or concentration are also acceptable. In other words, the present invention can very advantageously be applied to a recording apparatus having at least one of a monochromatic recording mode, a multi-color recording mode and a full-color recording mode. Specifically, the monochromatic recording mode is such that a single recording head is mounted on the recording apparatus so as to perform each recording operation by using only one main color such as black color or the like. The multi-color recording mode is such that a single recording head having an integral structure or a plurality of recording heads are mounted on the recording head so as to perform each recording operation by separately using plural kinds of different color inks. The full-color recording mode is such that a single recording head having an integral structure or a plurality of recorded heads are mounted on the recording apparatus so as to perform each recording operation by using plural kinds of different color inks in the mixed state.

In each of the embodiments of the present invention as described above, each ink two be used has been explained as a liquid. Alternatively, ink which is kept solid at a temperature equal to or lower than a room temperature but softened or liquidized at the room temperature may be used. In the ink jet system, since the temperature of ink to be used is generally controllably adjusted within the temperature range of 30° C. or more to 70° C. or less so as to allow the viscosity of the ink to be maintained within the stable ejecting range, ink which is liquidized when a recording signal is applied to the recording head my be used. To positively prevent the temperature of ink from being elevated due to the thermal energy applied to the recording head by utilizing the energy arising when the solid state of ink is transformed to the liquid state or to prevent the ink from being vaporized, ink which is kept solid in the unused state but liquidized on receipt of heat may be used. At any rate, the present invention can be applied to the case that in response to a recording signal, ink is liquidized on receipt of thermal energy and the liquid ink is then ejected from the recording head, the case that ink starts to be solidified when an ink droplet reaches a recording medium, and the case ink having such a nature that it is liquidized only in response to application of thermal energy to the recording head. In such cases, while ink is retained in concavities or through holes formed in a porous sheet material in the form of a liquid substance or a solid substance, the ink faces to the electrothermal transducers as described in an official gazette of Japanese Patent Laid-Open Publication NO. 54-56847 or Japanese Patent Laid-Open Publication NO. 60-71260.

According to the present invention, a most. advantageous result can be obtained with any one of the aforementioned kinds of inks when the film boiling system is executed.

In addition, the ink jet recording apparatus of the present invention can be employed not only as an image output terminal of an information processing apparatus such as a computer or the like but also as an outputting apparatus of a copying machine combined with an optical reader and as an outputting apparatus of a facsimile having a signal sending/receiving function. Further, it is desirable that the present invention is applied to a dyeing apparatus adapted to perform a recording (printing) operation for a cloth, threads or the like or a dyeing system combined with an apparatus for executing preliminary treatment or aftertreatment.

The present invention has been described in detail with respect to preferred embodiments, and it will now be that changes and modifications maybe made without departing from the invention in its broader aspects, and it is the intention, therefore, in the appended claims to cover all such changes and modifications as fall within the true spirit of the invention.

What is claimed is:

1. A recording apparatus comprising:

a recording head used for recording inputted information on a recording medium by ejecting a recording liquid from a plurality of orifices formed thereon;

means connected to said recording head for supplying a drive signal for driving said recording head; and means for transferring said recording medium, wherein said recording head includes:

a substrate in which a plurality of recording elements are selectively driven for heating said recording liquid;

a plurality of functional elements arranged in a semiconductor layer for selectively feeding a driving signal to said recording elements so as to eject ink from a plurality of ejection ports formed on said recording head, each of said functional elements being electrically connected to one side of a corresponding one of said recording elements, a plurality of functional element electrodes arranged in a conductor electrode layer and connecting, respectively, said functional elements in said semiconductor layer; and a common electrode for feeding said driving signal to said recording elements and also arranged in said conductor electrode layer and electrically connected to another side of said recording elements; and said common electrode being in the same layer which is formed during the same step as that of forming said conductor electrode layer.

2. A recording apparatus as claimed in claim 1, wherein said common electrode is electrically connected to a metallic film formed above said common electrode via an electrical insulative layer and through holes.

3. A recording apparatus as claimed in claim 1, wherein said recording elements are prepared as a film under conditions different from those employable for a step of involving said common electrode, said functional elements and a driving integrated circuit in said substrate.

4. A recording apparatus as claimed in claim 1, wherein said recording head is an inkjet recording head and said recording element is a thermal transducer for generating thermal energies in correspondence with said driving signal to cause film boiling in said recording liquid and thereby eject said recording liquid from said orifices.

5. A recording apparatus as claimed in claim 1, wherein said recording head detachably connects with an ink tank to form a recording cartridge and receives said recording liquid from said ink tank.

6. A recording apparatus as claimed in claim 1, wherein said recording medium is selected from paper, cloth, and plastic sheet.

7. A recording apparatus as claimed in claim 1, wherein said recording liquid is ink.

8. A color recording apparatus comprising:

a recording head used for recording inputted color information on a recording medium by ejecting a recording liquid from a plurality of orifices formed thereon;

means connected to said recording head for supplying a drive signal for driving said recording head; and means for transferring said recording medium, wherein said recording head includes:

a substrate in which a plurality of recording elements are selectively driven for heating said recording liquid;

a plurality of functional elements arranged in a semiconductor layer for selectively feeding a driving signal to said recording elements so as to eject ink from a plurality of ejection ports formed on said recording head, each of said functional elements being electrically connected to one side of a corresponding one of said recording elements, a plurality of functional element electrodes arranged in a conductor electrode layer and conducting, respectively, said functional elements in said semiconductor layer; and a common electrode also arranged in said conductor electrode layer and electrically connected to another side of said recording elements; and said common electrode being in the same layer which is formed during the same step as that of forming said conductor electrode layer.

9. A color recording apparatus as claimed in claim 8, wherein said common electrode is electrically connected to a metallic film formed above said common electrode via an electrical insulative layer and through holes.

10. A color recording apparatus as claimed in claim 9, wherein said recording elements are prepared as a film under conditions different from those employable for a step of involving said common electrode, said functional elements and a driving integrated circuit in said substrate.

11. A color recording apparatus as claimed in claim 8, wherein said recording head is an ink-jet recording head and said recording element is a thermal transducer for generating thermal energies in correspondence with said driving signal to cause film boiling in said recording liquid and thereby eject said recording liquid from said orifices.

12. A color recording apparatus as claimed in claim 8, wherein said recording head detachably connects with an ink tank to form a recording cartridge and receives said recording liquid from said ink tank.

13. A color recording apparatus as claimed in claim 8, wherein said recording medium is selected from paper, cloth, and plastic sheet.

14. A color recording apparatus as claimed in claim 8, wherein said recording liquid is ink.

15. A color recording apparatus as claimed in claim 8, wherein said recording head serves as multicolor recording means for multi-color recording on said recording medium, said recording head having groups of a plurality of recording elements assembled with each other corresponding to plural kinds of colors to be used, and wherein a plurality of common electrodes are dividedly arranged corresponding to said plural kinds of colors on a block unit basis.

16. A color recording apparatus as claimed in claim 8, wherein said groups of a plurality of recording elements are cascade-connected to each other.

17. A substrate for a recording head used for recording inputted information on a recording medium, comprising:

a plurality of recording elements a plurality of functional elements arranged in a semiconductor layer for selectively feeding a driving signal to said recording elements, each of said functional elements being electrically connected to one side of a corresponding one of said recording elements, a plurality of functional element electrodes arranged in a conductor electrode layer and conducting, respectively, said functional elements in said semiconductor layer; and a common electrode also arranged in said conductor electrode layer, and electrically connected to another side of said recording elements; and said common electrode being in the same layer which is formed during the same step as that of forming said conductor electrode layer.

18. A substrate for recording head as claimed in claim 17, wherein said common electrode is electrically connected to a metallic film formed above said common electrode via an electrical insulative layer and through holes.

19. A substrate for a recording head as claimed in claim 17, wherein said recording elements are prepared as a film under conditions different from those employable for a step of involving said common electrode, said functional elements and a driving integrated circuit in said substrate.

20. A substrate for a recording head as claimed in claim 17, wherein said recording head serves as multicolor recording means for multi-color recording on said recording medium, said recording head having groups of a plurality of recording elements assembled with each other corresponding to plural kinds of colors to be used, and wherein a plurality of common electrodes are dividedly arranged corresponding to said plural kinds of colors on a block unit basis.

21. A substrate for a recording head as claimed in claim 17, wherein said groups of a plurality of recording elements are cascade-connected to each other.

22. A substrate for a recording head as claimed in claim 17, wherein said recording head is an ink-jet recording head and said recording element is a thermal transducer for generating thermal energies in correspondence with said driving signal to cause film boiling in said recording liquid and thereby eject said recording liquid from said orifices.

* * * * *

UNITED STATES PATENT AND TRADEMARK OFFICE

CERTIFICATE OF CORRECTION

PATENT NO. : 6,137,509
DATED : October 24, 2000
INVENTOR(S) : Kimiyuki Hayasaki

It is certified that error appears in the above-identified patent and that said Letters Patent is hereby corrected as shown below:

Column 1
Line 34, "few noisy sound" should read -- fewer noisy sounds --;
Line 66, "practiced-at" should read -- practiced at --.

Column 2,
Line 18, "a various kind" should read -- various kinds --.

Column 3
Line 56, "ot" should read -- of --;
Line 62, "from." should read -- from --.

Column 4
Line 11, "including," should read -- including --;
Line 42, "are" (sense) should read -- is --;
Line 60, "connect" should read -- be connected.

Column 5
Line 16, "are" (sense) should read -- is --;
Line 28, "inkjet" should read -- ink-jet --;
Line 34, "connect" should read -- be connected --;
Line 41, "element" should read -- elements --.

Column 6
Line 46, "a" should be deleted;
Line 50, "of" should read -- of the --.

Column 7
Line 14, "another-block" should read -- another block --;
Line 21, "embodiment of the embodiment" should read -- embodiments --;
Line 24, "base," should read -- base --;
Line 67, "modification" should read -- modifications --.

Column 8
Line 60, "an" should read -- a --;
Line 64, "1023,.a" should read -- 1023, a --.

Column 9
Line 27, "agate" should read -- a gate --;

UNITED STATES PATENT AND TRADEMARK OFFICE

CERTIFICATE OF CORRECTION

PATENT NO. : 6,137,509
DATED : October 24, 2000
INVENTOR(S) : Kimiyuki Hayasaki

It is certified that error appears in the above-identified patent and that said Letters Patent is hereby corrected as shown below:

Column 9 contd.
Line 39, "reference-numerals" should read -- reference numerals --; and "designates" should read -- designate --.

Column 10
Line 3, output-from" should read -- output from --;
Line 34, "is" should read -- are --;
Line 36, "is" should read -- are --;
Line 38, "is" should read -- are --;
Line 64, "MIN" should read -- M/N --.

Column 11
Line 6, "tour," should read -- four --.

Column 13
Line 27, "same" should read -- same, --.

Column 14
Line 14, "are" should read -- are --;
Line 30, "1418" should read -- 2418 --; and "1423," should read -- 2424, --;
Line 31, "conductor" should read -- conductor 2420 --.

Column 15
line 13, "designates" should read -- designate --.

Column 16
Line 7, "cartridge" should read -- cartridges --;
Line 52, "ad" should read -- and --.

Column 17,

Line 20, "type" should read -- types --.

Column 18
Line 7, "and-black" should read -- and black --;
Line 26, "firm" should read -- film --;
Line 31, "few" (sense) should read -- little --.

UNITED STATES PATENT AND TRADEMARK OFFICE

CERTIFICATE OF CORRECTION

PATENT NO. : 6,137,509
DATED : October 24, 2000
INVENTOR(S) : Kimiyuki Hayasaki

It is certified that error appears in the above-identified patent and that said Letters Patent is hereby corrected as shown below:

Column 19
Line 34, "gazettes" should read -- gazettes of --;
Line 38, "NO." should read -- No. --;
Line 42, "NO." should read -- No. --;
Line 52, "apparatus" should read -- apparatus. --.

Column 20
Line 19, "or" should read -- of --;
Line 39, "two" should read -- to --;
Line 48, "my" should read -- may --;
Line 59, "case" should read -- case of --.

Column 21
Line 61, "inkjet" should read -- ink-jet --.

Column 23
Line 6, "elements a" should read -- ¶ a --;
Line 22, "for" should read -- for a --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*